US010240892B2

(12) United States Patent
Leitner-Wise

(10) Patent No.: US 10,240,892 B2
(45) Date of Patent: Mar. 26, 2019

(54) HANDGUARDS AND UPPER RECEIVERS ALONE AND IN COMBINATION

(71) Applicant: Paul Leitner-Wise, Alexandria, VA (US)

(72) Inventor: Paul Leitner-Wise, Alexandria, VA (US)

( * ) Notice: Subject to any disclaimer, the term of this patent is extended or adjusted under 35 U.S.C. 154(b) by 0 days.

(21) Appl. No.: 15/701,887

(22) Filed: Sep. 12, 2017

(65) Prior Publication Data

US 2018/0128571 A1 May 10, 2018

Related U.S. Application Data

(60) Provisional application No. 62/394,206, filed on Sep. 13, 2016.

(51) Int. Cl.
*F41C 23/16* (2006.01)
*F41A 3/66* (2006.01)
*F41G 11/00* (2006.01)

(52) U.S. Cl.
CPC ..... *F41C 23/16* (2013.01); *F41A 3/66* (2013.01); *F41G 11/003* (2013.01)

(58) Field of Classification Search
CPC ..... F41C 23/16; F41A 3/66
USPC ..... 42/71.01, 90, 72
See application file for complete search history.

(56) References Cited

U.S. PATENT DOCUMENTS

| | | | | |
|---|---|---|---|---|
| 4,670,914 | A * | 6/1987 | Harris | A61F 9/028 2/426 |
| 8,037,633 | B1 * | 10/2011 | Troy | F41C 23/16 42/71.01 |
| 9,389,043 | B1 * | 7/2016 | Zhang | F41C 23/16 |
| 9,599,430 | B1 * | 3/2017 | Geissele | F41C 23/16 |
| 9,683,808 | B2 * | 6/2017 | Gagnon | F41C 23/16 |
| 2014/0260943 | A1 * | 9/2014 | Alis | F41A 3/54 89/154 |
| 2015/0198396 | A1 * | 7/2015 | Motley | F41A 3/66 42/90 |
| 2016/0298926 | A1 * | 10/2016 | Jen | F41C 27/00 |

OTHER PUBLICATIONS

Aero Precision's AR15 M4E1 Enhanced Upper & Handguard, internet article (https://www.tactical-life.com/gear/aero-precisions-ar15-rn4e1-enhanced-upper-handguard-new-product/). (Year: 2014).*

* cited by examiner

*Primary Examiner* — Reginald S Tillman, Jr.

(57) ABSTRACT

In one embodiment the invention is a hand guard, comprising: a generally hollow cylindrical body having a rail securing top surface; a top Picatinny rail securable to the rail securing top surface. The top rail is in slidable engagement with the rail securing top surface such that the top Picatinny rail is removable from the top surface. The generally hollow cylindrical body is populated with vent holes. In another embodiment an upper receiver is provided, the upper receiver includes a front face located at a front end of the upper receiver, the upper receiver having a Picatinny rail atop thereof, the Picatinny rail having a last rail located at a front end of the Picatinny rail, the last rail is aligned with the front face. In another embodiment the hand guard has a fixed Picatinny rail atop thereof. At least one plug is optionally provided for fitting into vent holes.

1 Claim, 37 Drawing Sheets

SECTION A-A

SECTION B-B

SECTION C-C

SECTION D-D

| Description of Parts | |
|---|---|
| 100 | a hand guard 100 |
| 110 | a gun stock |
| 120 | a generally hollow single piece cylindrical body 120 of hand guard 100 |
| 125, 127 | left 125 and right 127 sides of the cylindrical body 120 |
| 130 | vent holes 130 |
| 140 | a top surface 140 |
| 160 | a Picatinny rail 160 atop of cylindrical body 120 |
| 163f, 163r | front 163f and rear 163r opposite ends of rail 160 |
| 180, 200 | front 180 and rear 200 opposite open ends of cylindrical body 120 |
| 220 | a bottom side 220 of cylindrical body 120 |
| 240 | a longitudinal axis 240 of cylindrical body 120 |
| 260 | a barrel clamp 260 of cylindrical body 120 |
| 270 | a bolt 270 |
| 280a,280b | first 280a and second 280b tabs of cylindrical body 120 |
| 300 | an upper receiver 300 |
| 302 | a top surface 302 of the upper receiver 300 |
| 304a, 304b | first 304a and second 304b external elongated recesses |
| 310f, 310r | front 310f and rear 310r opposite ends of upper receiver 300 |
| 315 | a barrel nut 315 |
| 320 | a Picatinny rail 320 atop of the upper receiver 300 |
| 325f, 325r | front 325f and rear 325r opposite ends of rail 320 |
| 340a, 340b | left 340a and right 340b sides of the upper receiver 300 |
| 360 | gun barrel 360 |
| 365 | combination rail 365 made up of rails 160 and 320. |
| 370 | front face 370 of upper receiver 300 |
| 375 | last rail 375 located at front end 325f of rail 320 |
| 400 | a hand guard 400 (second embodiment) |
| 420 | a generally hollow cylindrical body 420 of hand guard 400 |
| 430 | vent holes 430 |
| 440 | a rail securing top surface 440 |

*FIG. 23A*

| Description of Parts (continued) | |
|---|---|
| 460 | a picatinny top rail 460 in slidable engagement with the rail securing surface 140 such that the rail 460 is securable to and removable from the rail securing top surface 440 |
| 463f, 463r | front 463f and rear 463r opposite ends of rail 460 |
| 470 | a longitudinal protrusion 470 |
| 480, 500 | front 480 and rear 500 opposite open ends of cylindrical body 420 |
| 520 | bottom side 520 of cylindrical body 420 |
| 540 | longitudinal axis 540 of cylindrical body 420 |
| 560 | a barrel clamp 560 |
| 570 | a bolt 570 |
| 580a, 580b | first 580a and second 580b tabs of cylindrical body 420 |
| 665 | combination rail 665 made up of rails 460 and 320 |
| 700 | at least one plug 700 |
| 720 | wire mesh 720 |
| 740 | perimeter 740 |
| 760 | rim 760 |
| 780 | at least one metal strip 780 |

*FIG. 23B*

HANDGUARDS AND UPPER RECEIVERS ALONE AND IN COMBINATION

CROSS REFERENCE TO RELATED APPLICATIONS

This application claims the benefit of U.S. Application No. 62/394,206, filed Sep. 13, 2016, the content of which is incorporated herein by reference in its entirety.

STATEMENT REGARDING FEDERALLY SPONSORED RESEARCH OR DEVELOPMENT

Not Applicable.

FIELD OF THE INVENTION

The present invention relates generally to hand guards for rifles such as, but not limited to, AR-15 type rifles.

BACKGROUND OF THE INVENTION

Rifles, such as AR-15 type rifles, typically have a hand guard that is attachable to an upper receiver. Prior art hand guards typically have a rail for fitting accessories. The prior art upper receiver typically has a rail. Typically, when the prior art hand guard is attached to the prior art upper receiver the rails work in combination thereby providing a longer rail for attaching accessories. However, the resulting combination of a prior art hand guard rail and upper receiver rail is typically not continuous in that a section of the combined rail proximate to or at the point of contact between the prior art hand guard rail and the prior art upper receiver rail is unavailable for use. Therefore, there is a need for a better hand guard and upper receiver to provide a continuous rail for attaching accessories thereto.

Moreover, prior art hand guards do not have removable or replaceable rails to allow a single hand guard to be quickly configured for various mission or hobby requirements. Therefore, there is also a need for hand guards that resolve this issue.

SUMMARY

In one embodiment the invention is a hand guard, comprising: a generally hollow single piece cylindrical body having a top surface. A Picatinny rail extends at least part way along the top surface. The Picatinny rail provides a mounting platform made up of rails with multiple transverse slots to mount, for example, telescopic sights. The cylindrical body has front and rear opposite open ends, a bottom side extending between the front and rear opposite ends, and a longitudinal axis. A barrel clamp is positioned at the rear end and which extends across the bottom side of the hand guard. The rear end includes first and second tabs located below the Picatinny rail and extending from the top surface at the rear end. The tabs are spaced apart such that upon connecting the rear end of the hand guard to an upper receiver the tabs are positioned on both sides of the upper receiver and below a Picatinny rail atop of the upper receiver. The generally hollow cylindrical body is populated with vent holes.

In a second embodiment the invention is a hand guard, comprising: a generally hollow cylindrical body having a rail securing top surface; a top rail securable to the rail securing top surface. The top rail is in slidable engagement with the rail securing top surface such that the top rail is removable from the top surface. The generally hollow cylindrical body is populated with vent holes.

In a further embodiment, plugs are inserted into vent holes for improving heat loss.

BRIEF DESCRIPTION OF THE DRAWINGS

FIGS. 23A and 23B show a description of parts.

Similar reference characters denote corresponding features consistently throughout the attached drawings.

DETAILED DESCRIPTION OF THE PREFERRED EMBODIMENTS OF THE INVENTION

FIGS. 23A and 23B collectively show a description of parts, which may be referred to throughout the detailed description herein. It should be understood that features of the present invention can be fitted to various different types of firearms and are expressly not limited to AR-15 rifles.

Figure 1A:
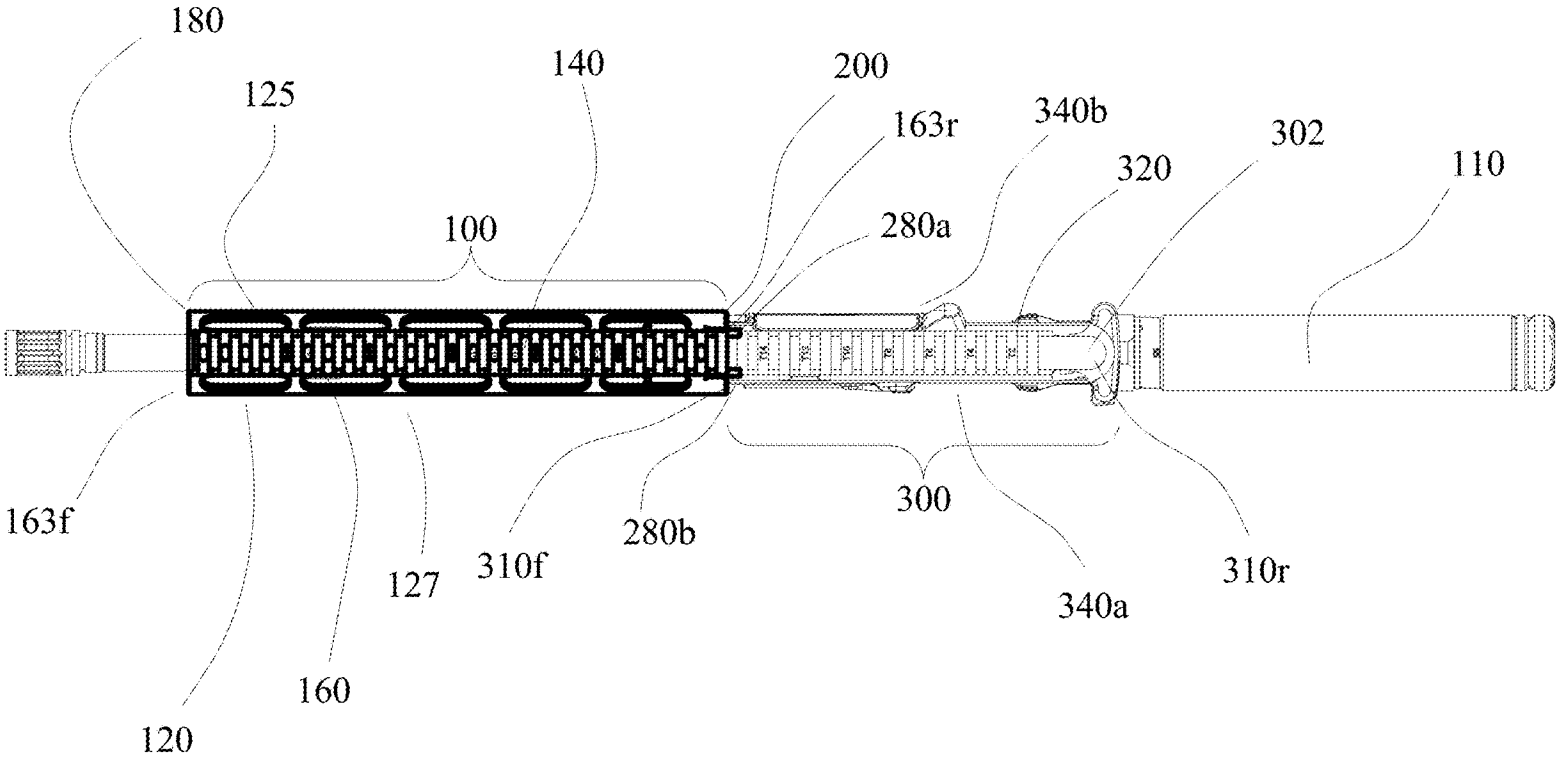
FIG. 1A is a top view of a rifle fitted with a hand guard and upper receiver (shown in outline) according to the present invention.
Figure 1B:
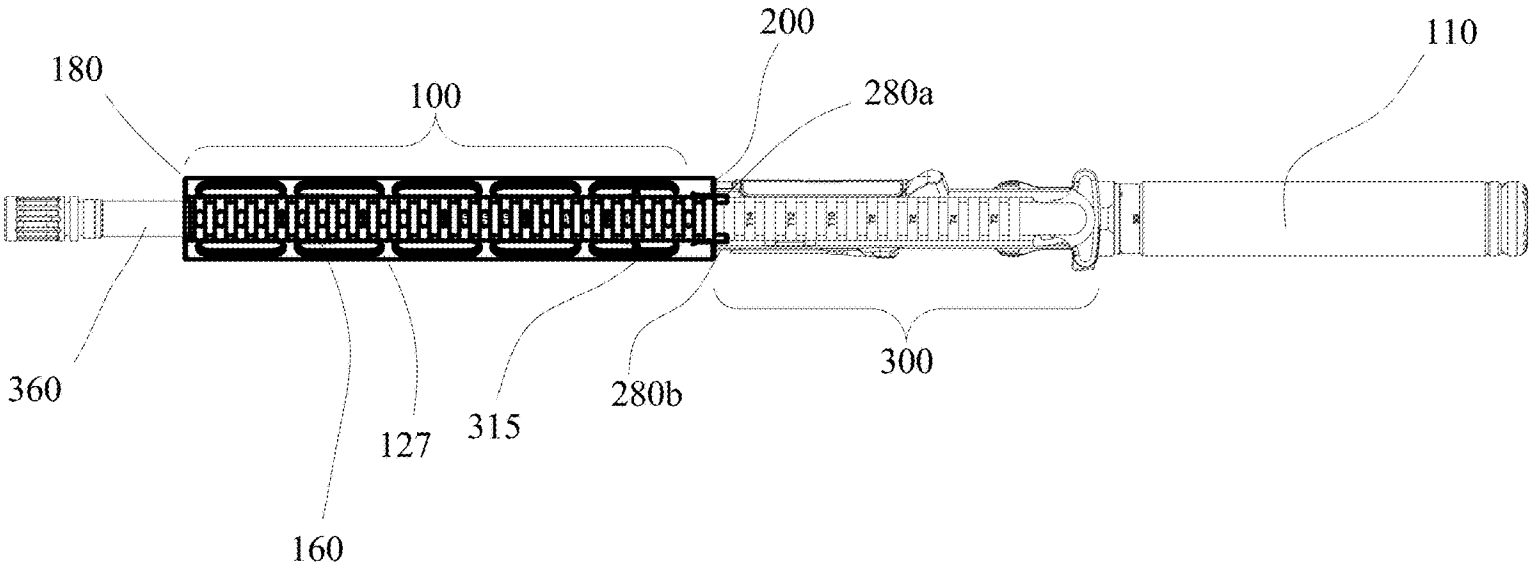
FIG. 1B is a further top view of a rifle fitted with a hand guard and upper receiver according to the present invention.
Figure 1C:
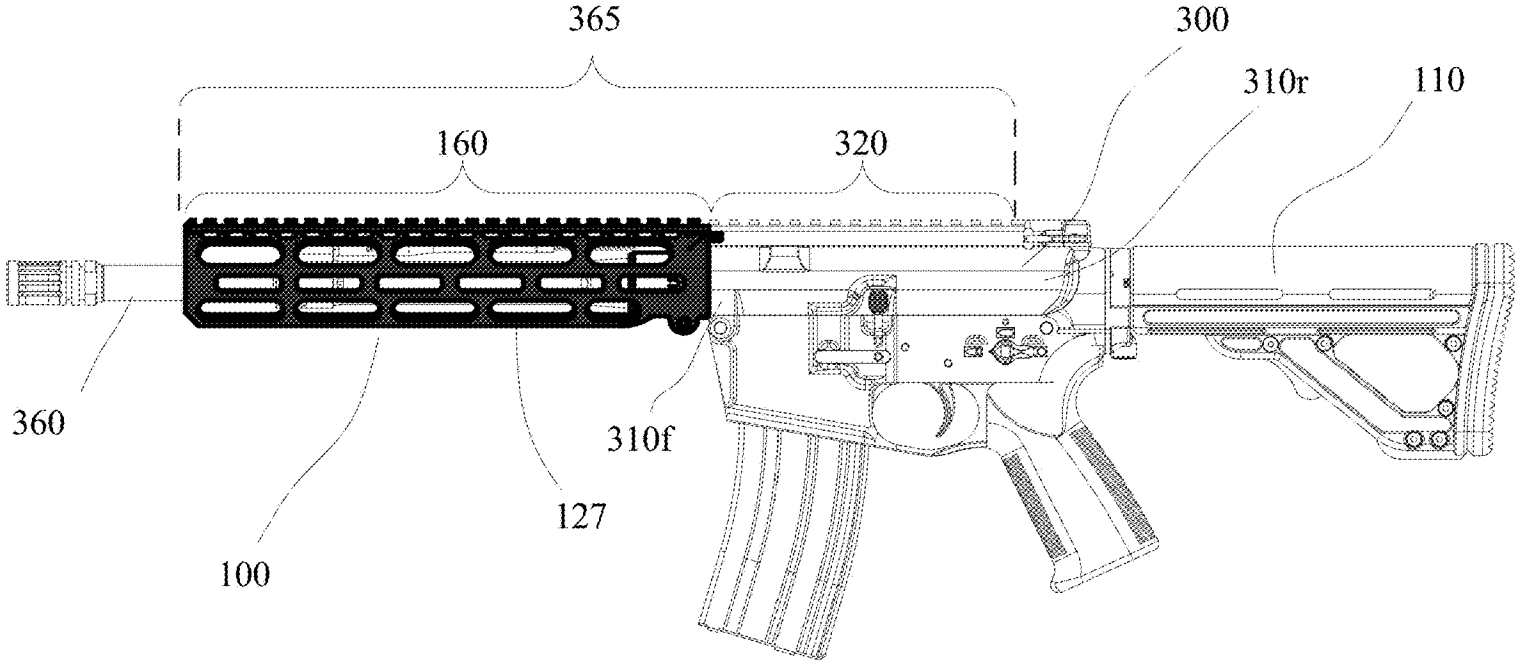
FIG. 1C is a right side view of the rifle shown in FIG. 1A.
Figure 2A:
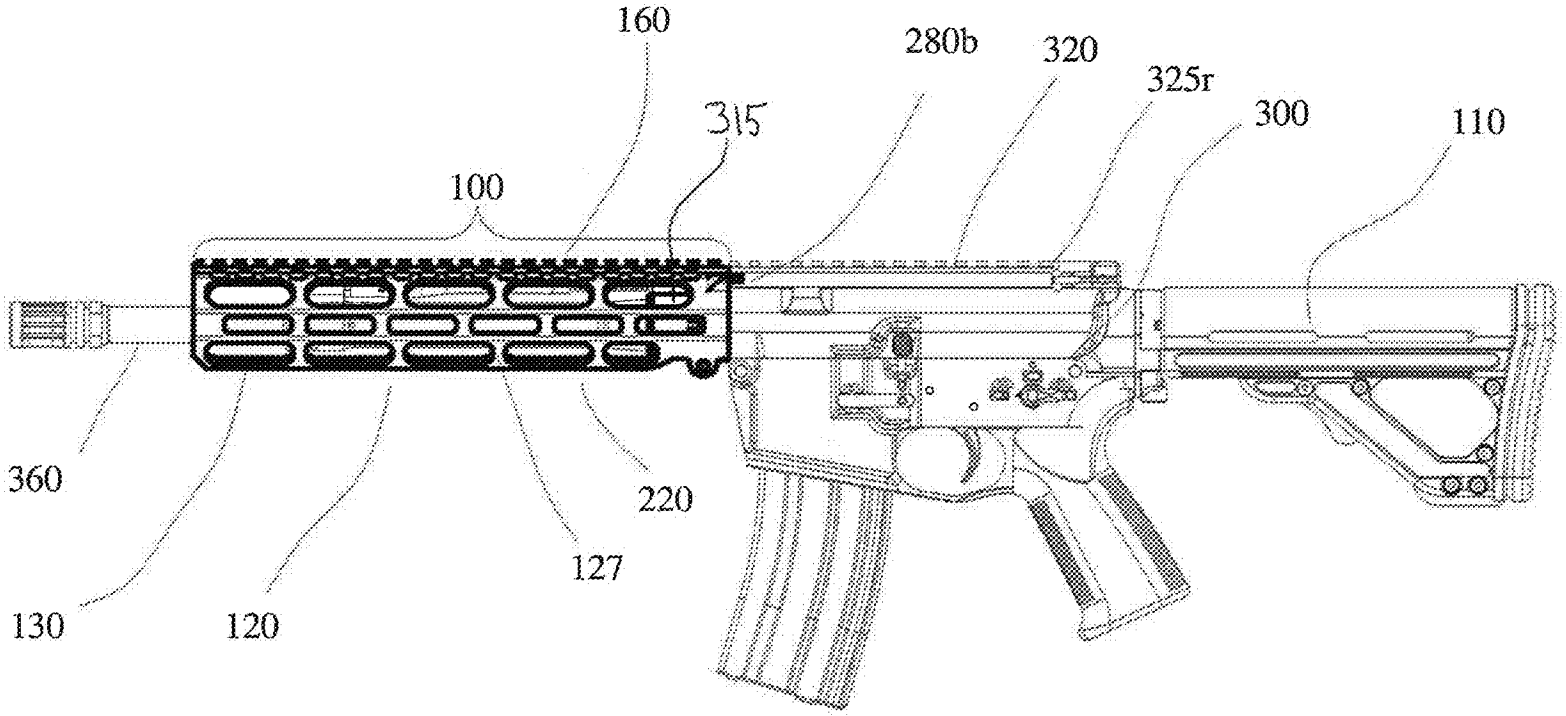
FIG. 2A is a right side view of the rifle shown in FIG. 1A.
Figure 2B:
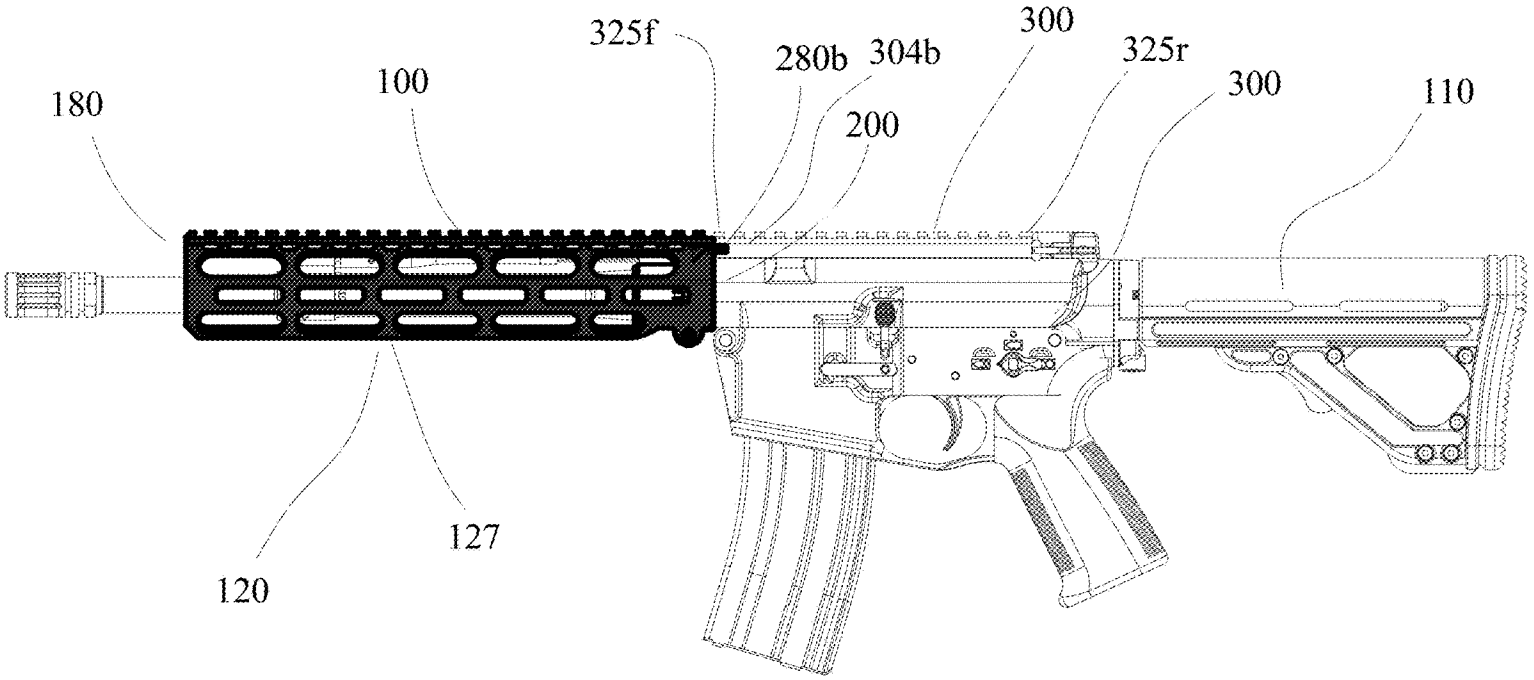
FIG. 2B is a further right side view of the rifle shown in FIG. 1A.
Figure 3A:
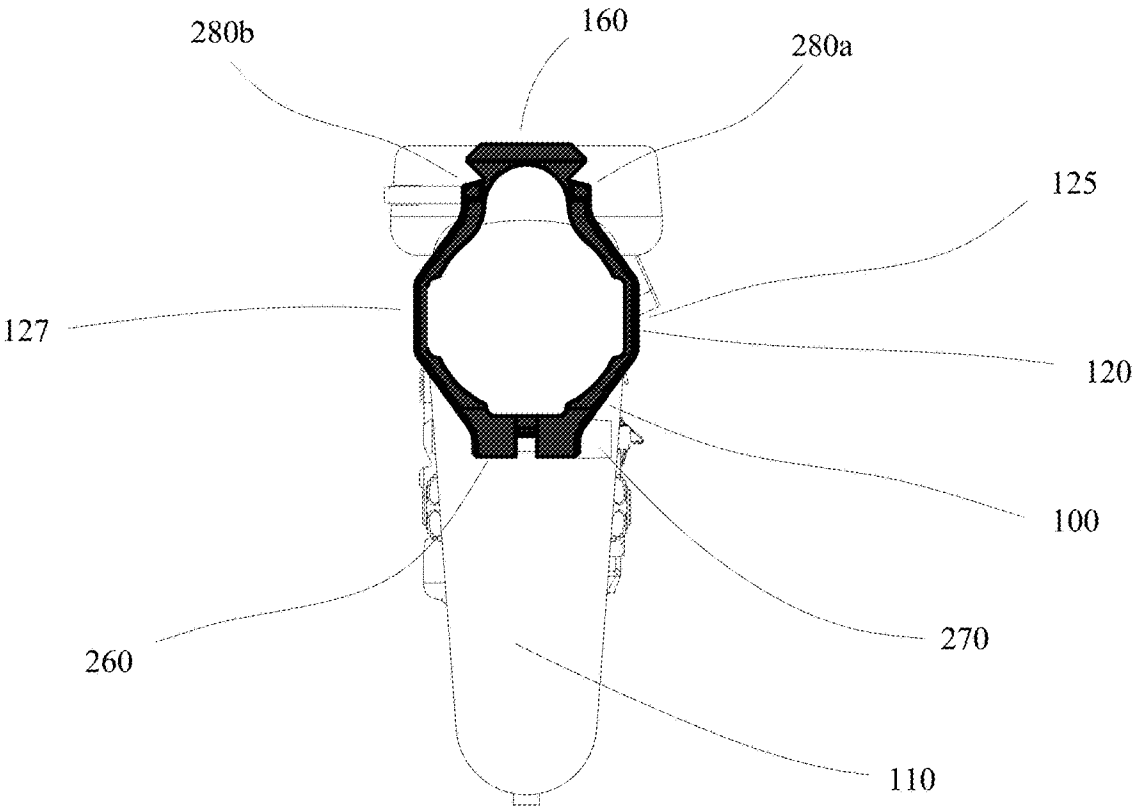
FIG. 3A is a rear end view of the hand guard shown in FIG. 1A with a barrel nut shown inside the hand guard.
Figure 3B:
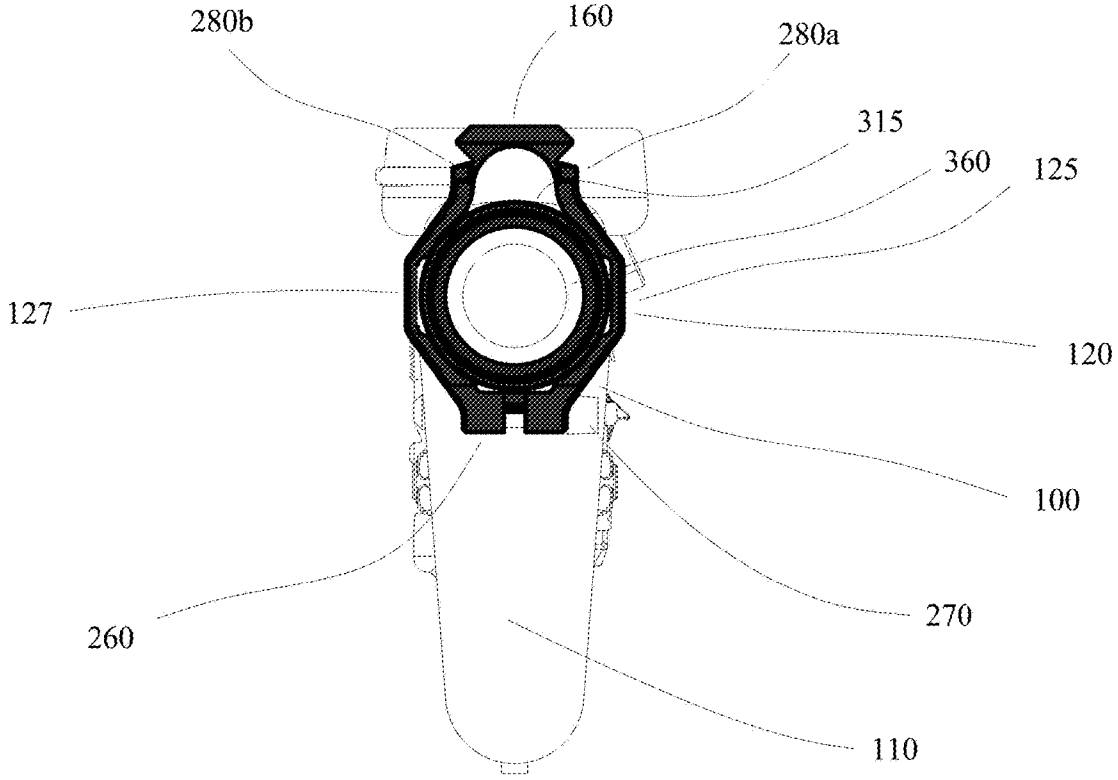
FIG. 3B is a front view of the rifle shown in FIG. 1A.
Figure 4:
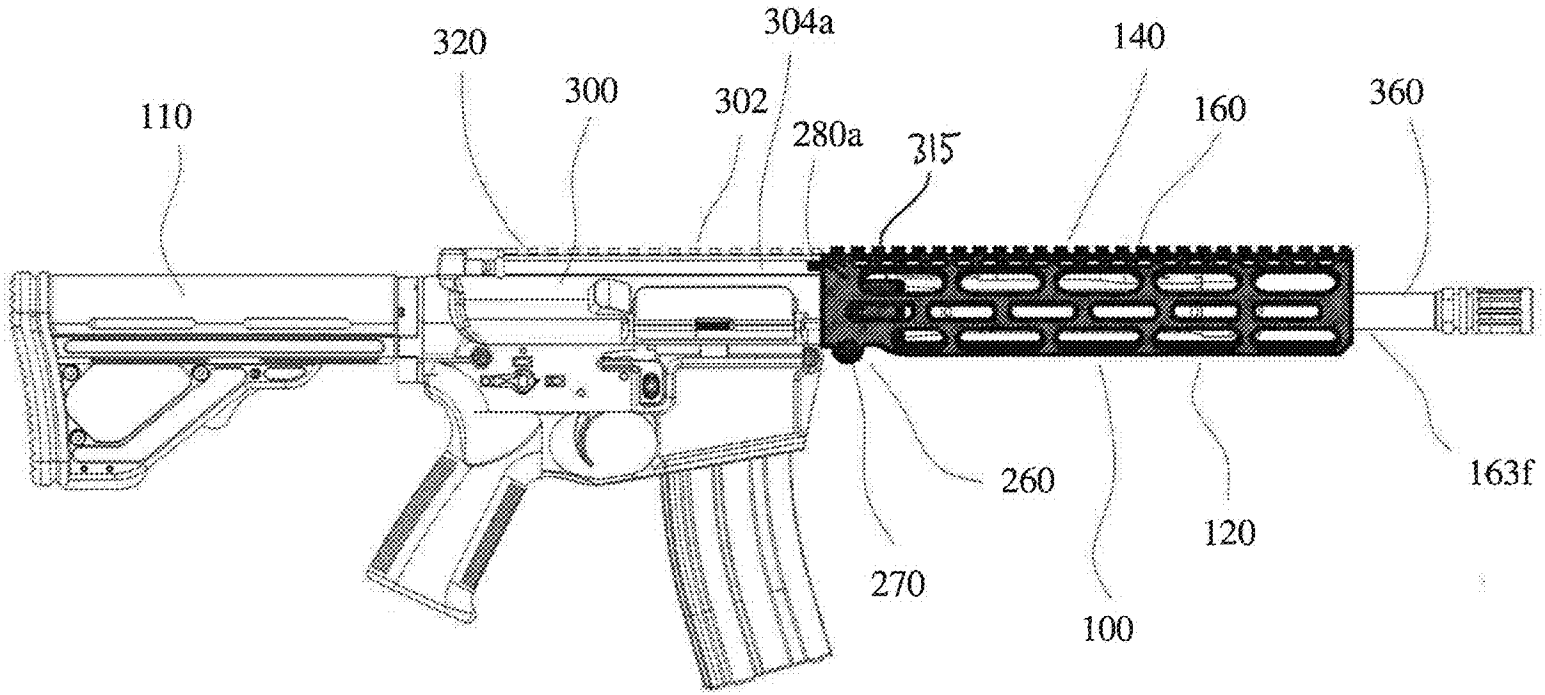
FIG. 4 is a left side view of the rifle shown in FIG. 1A.
Figure 5:
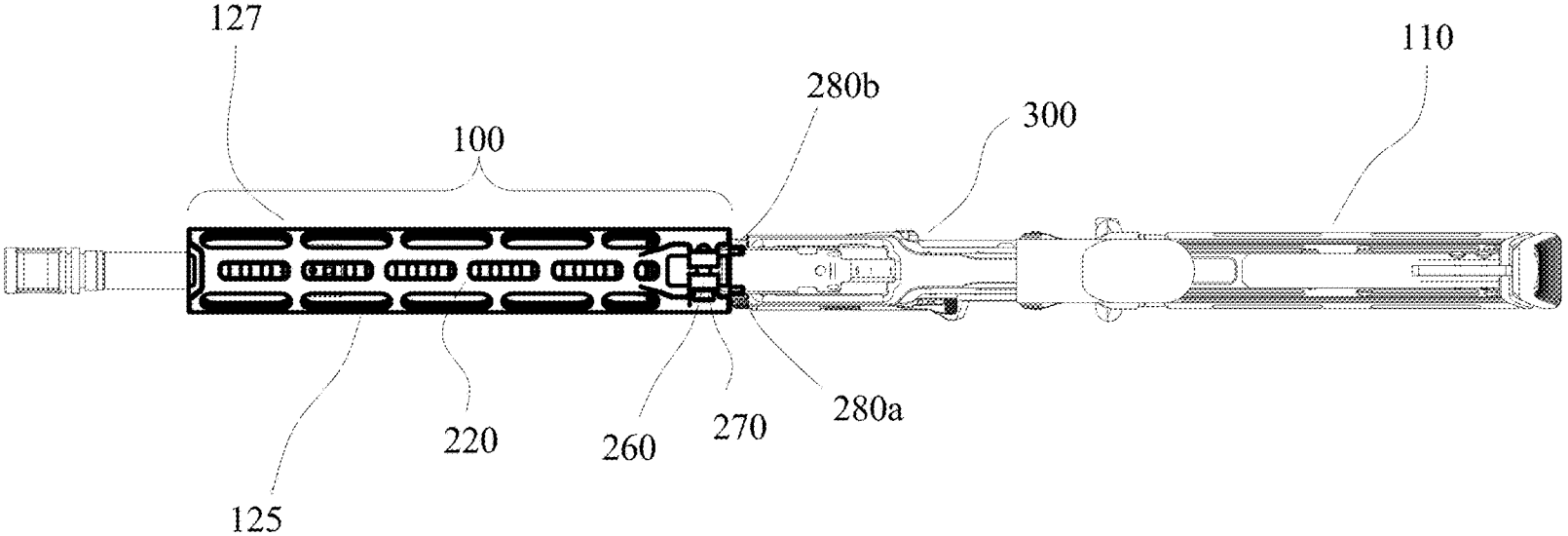
FIG. 5 is a bottom view of the rifle shown in FIG. 1A.
Figure 6:
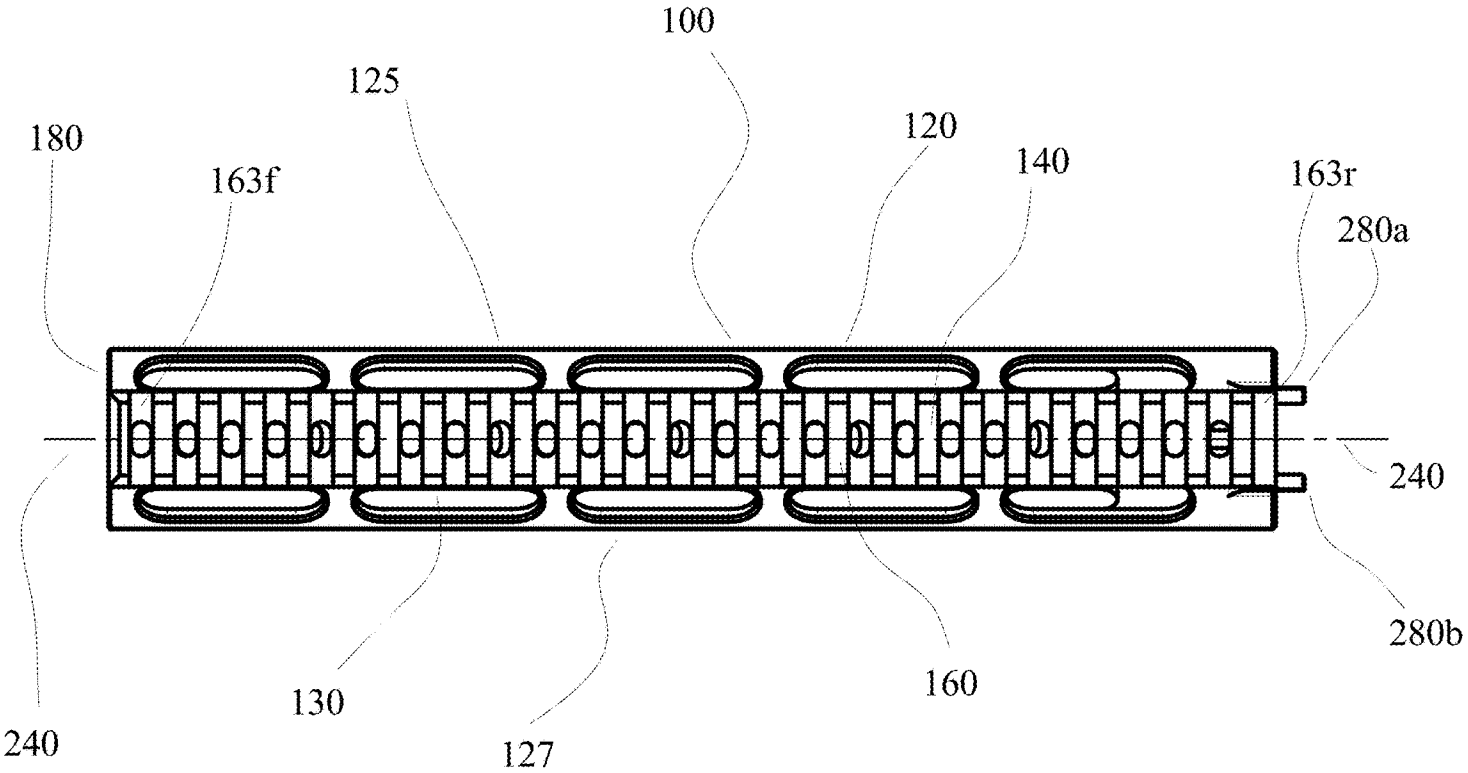
FIG. 6 is a top view of a hand guard according to the present invention.
Figure 7A:
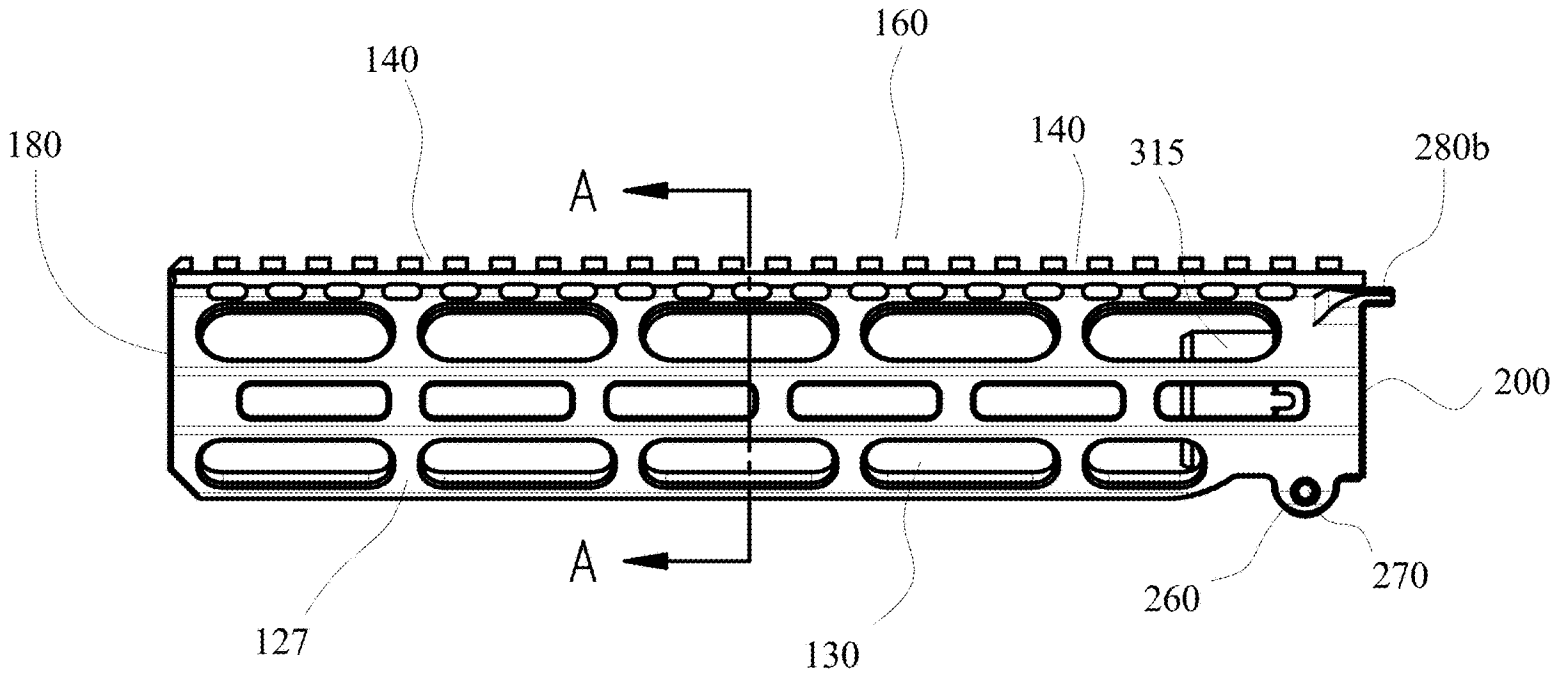
FIG. 7A is a right side view of the hand guard shown in FIG. 6.
Figure 7B:
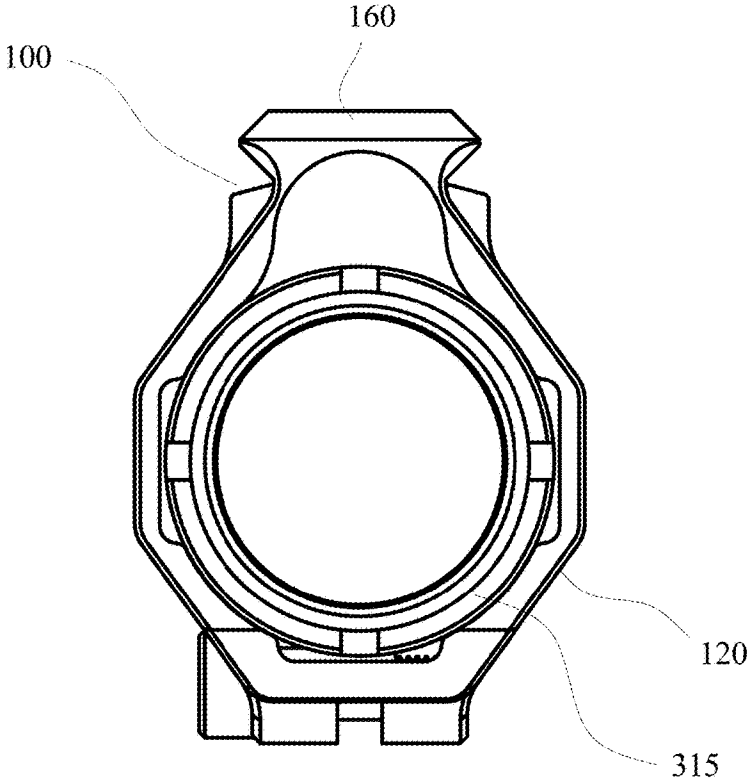
FIG. 7B is a front end view of the hand guard shown in FIG. 6 but with a barrel nut shown in situ.
Figure 7C:
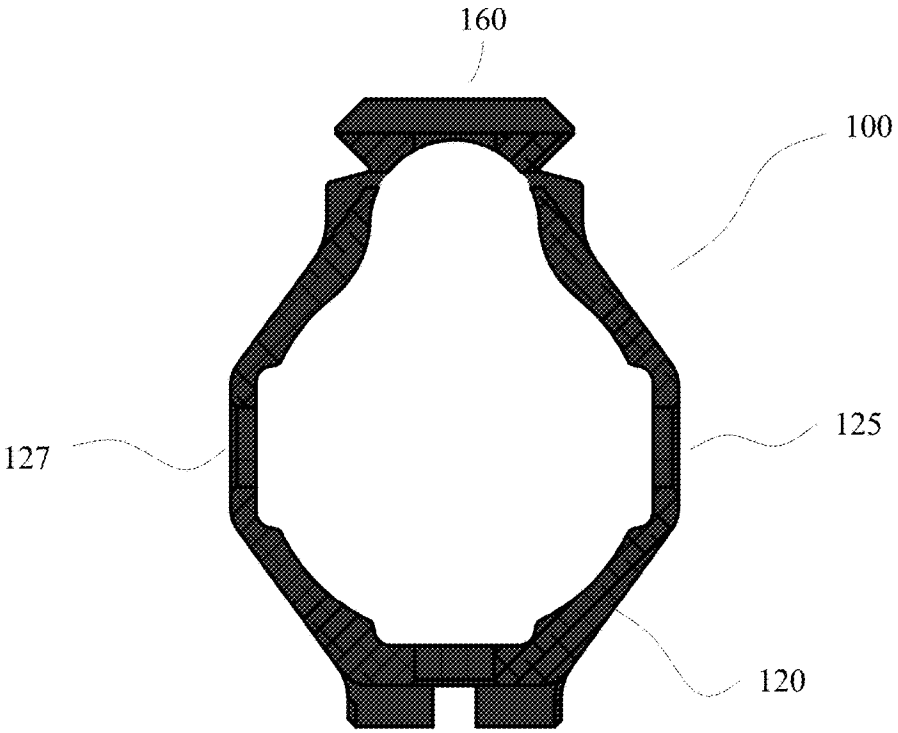
FIG. 7C is a section view along line A-A shown in FIG. 7A.
Figure 8A:
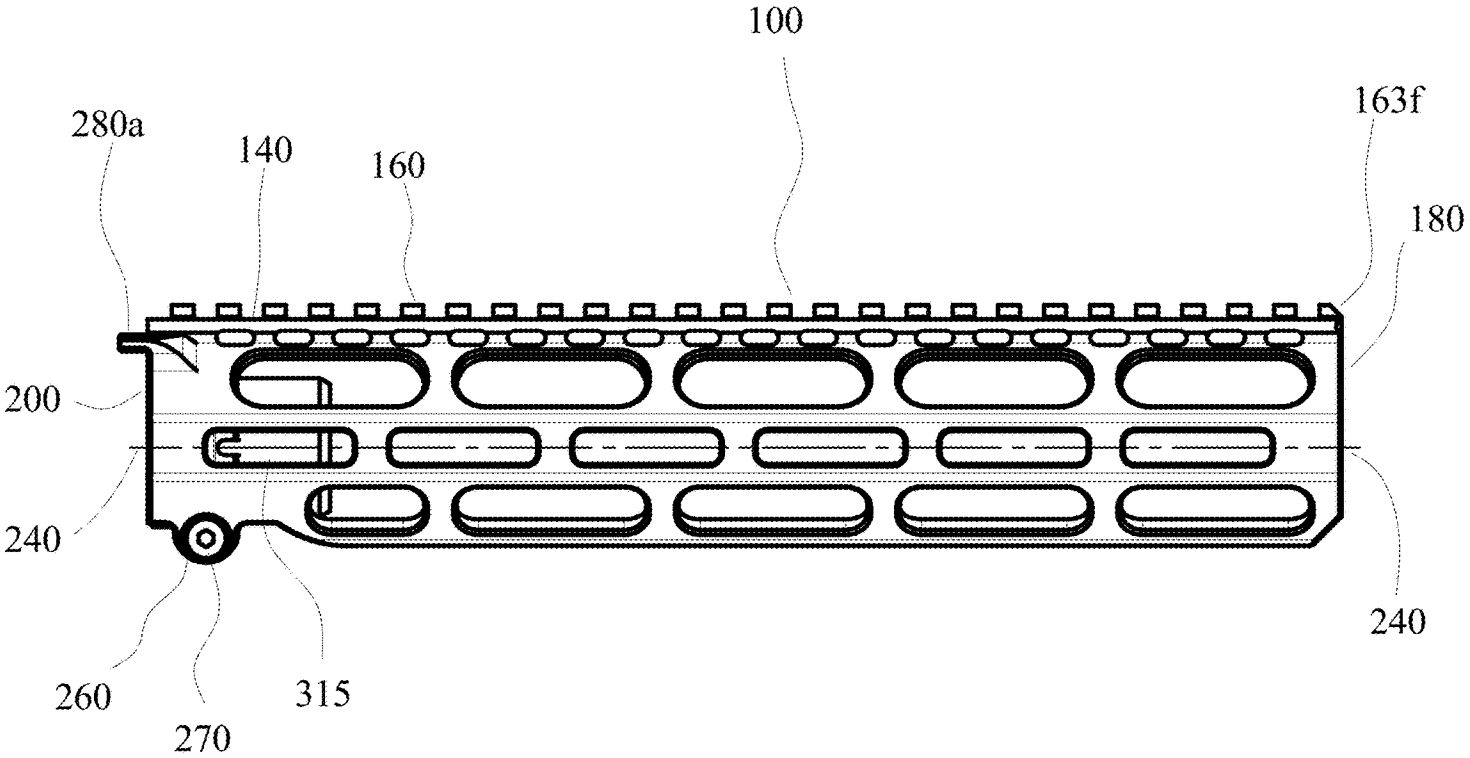
FIG. 8A is a left side view of the hand guard shown in FIG. 6.
Figure 8B:
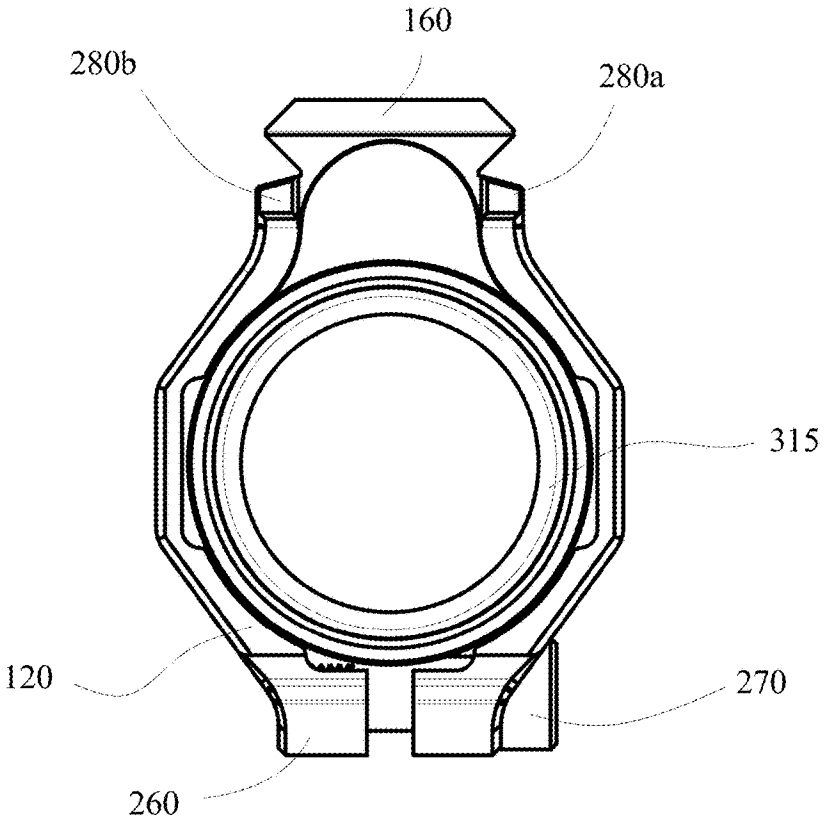
FIG. 8B is a rear end view of the hand guard shown in FIG. 6 but with a barrel nut shown in situ.
Figure 9A:
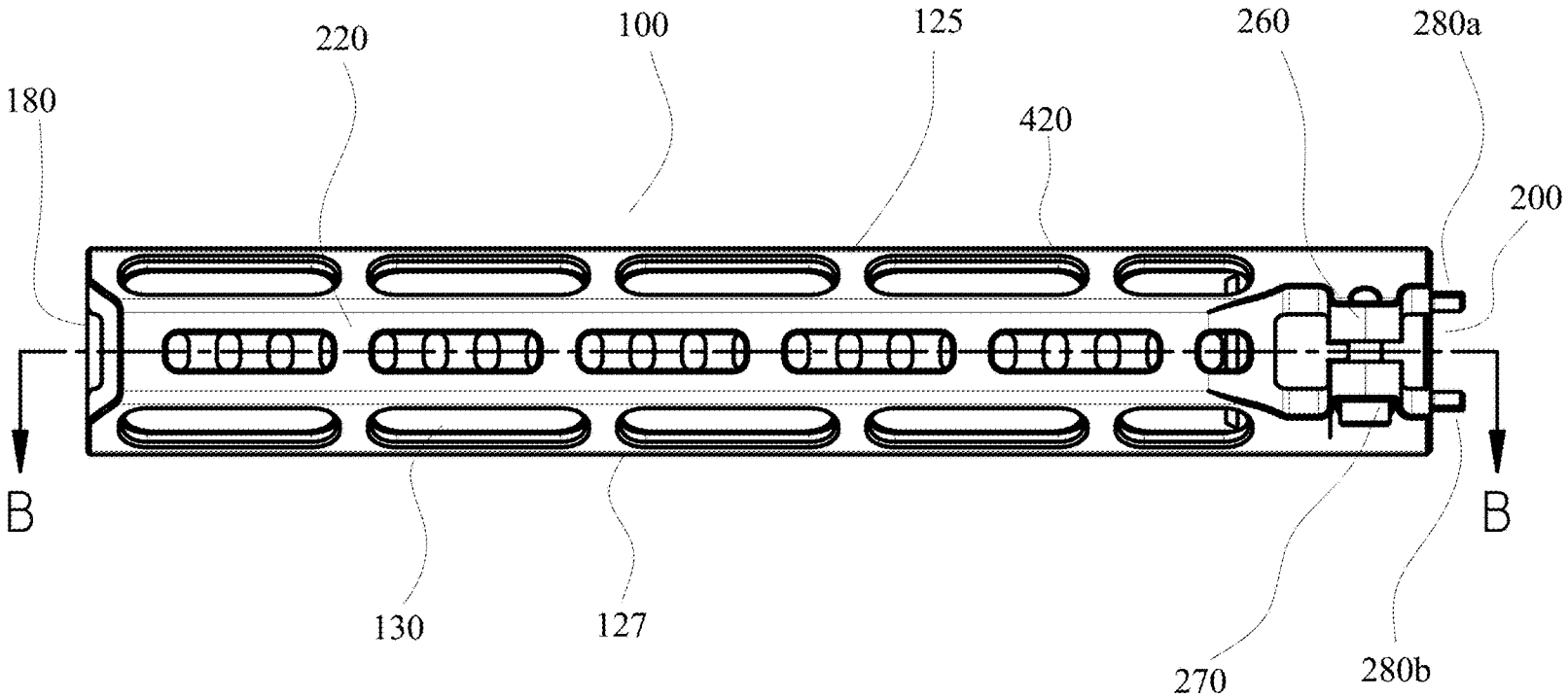
FIG. 9A is a bottom view of the hand guard shown in FIG. 6.
Figure 9B:
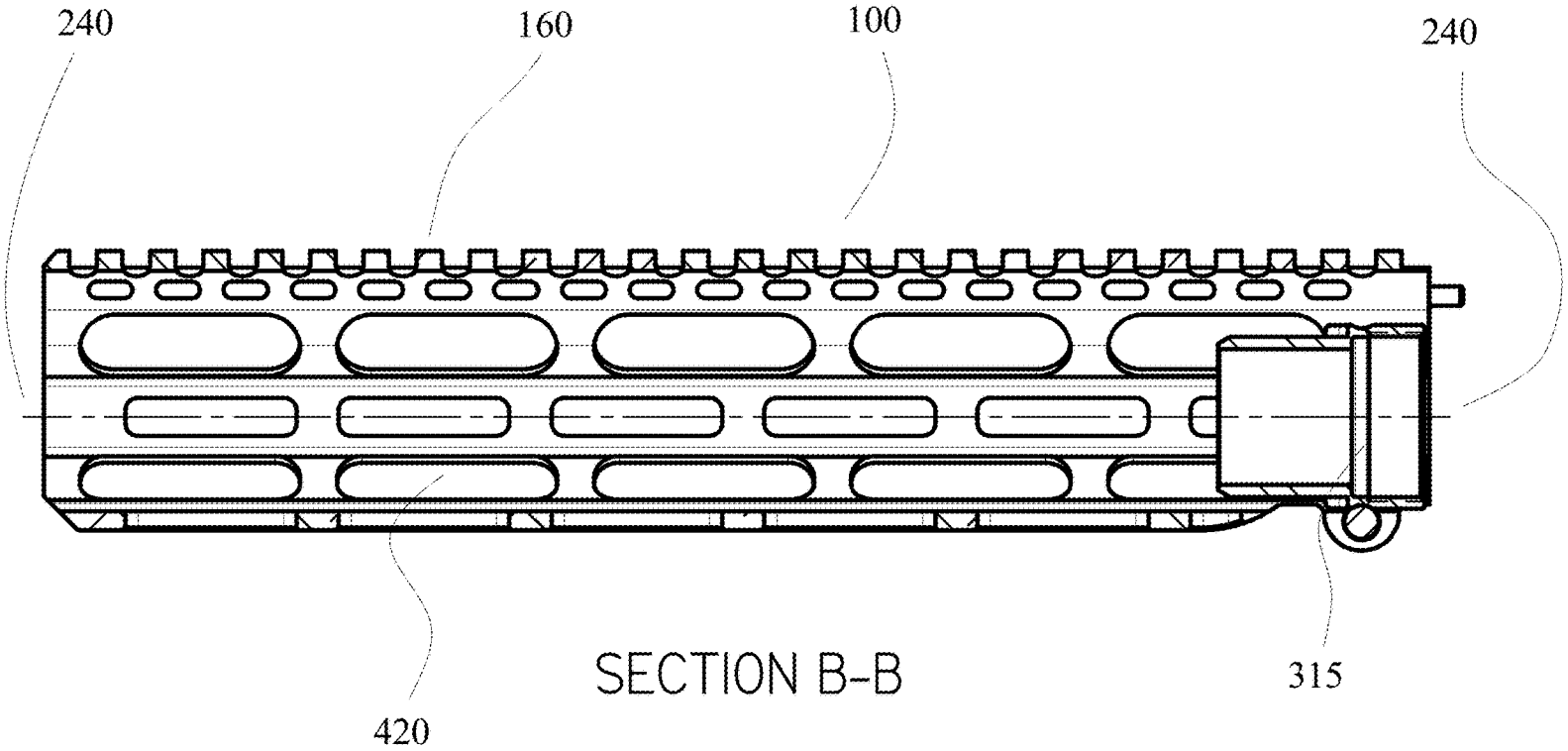
FIG. 9B is a section view along line B-B shown in FIG. 9A.
Figure 10:
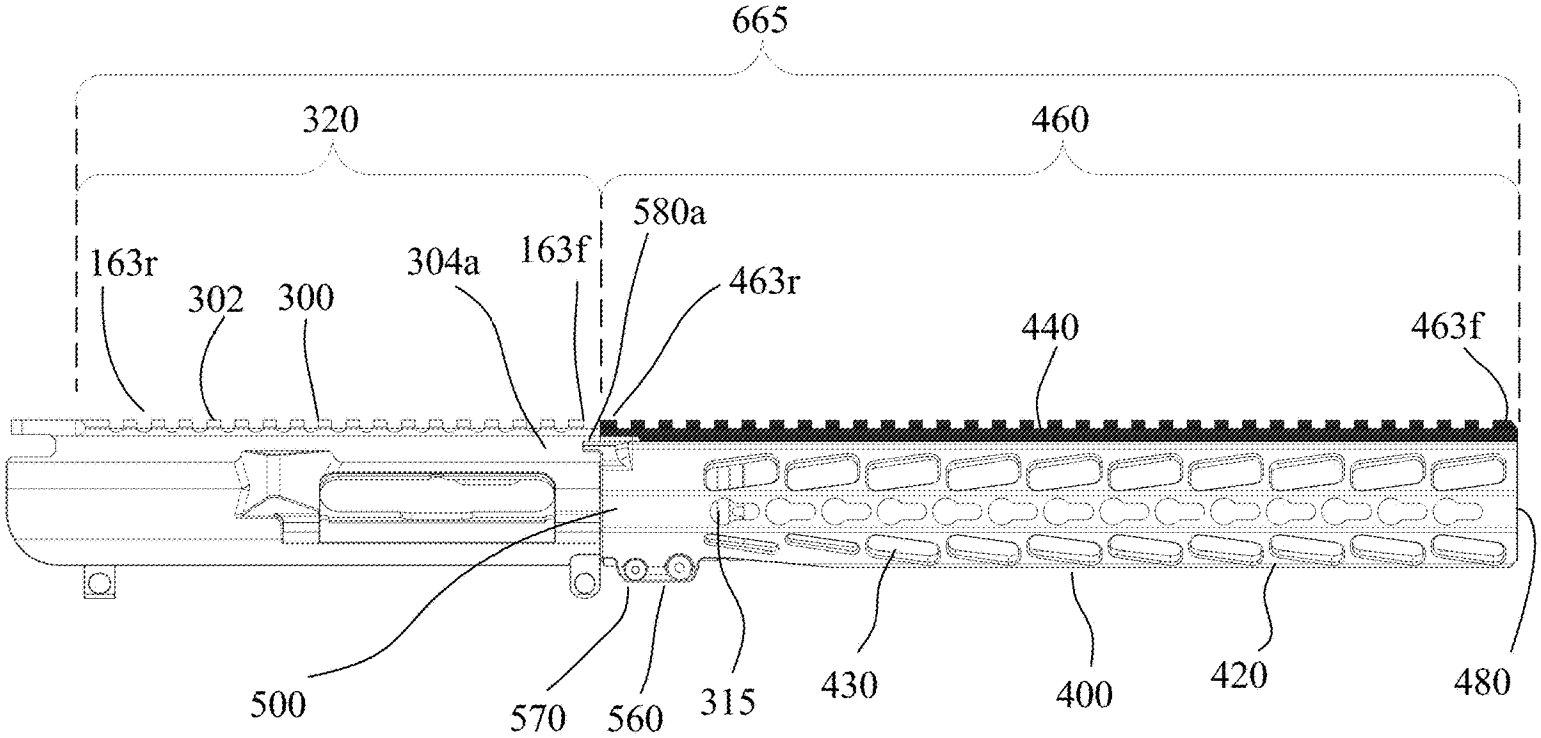
FIG. 10 shows a hand guard attached to an upper receiver according to the present invention.
Figure 11:
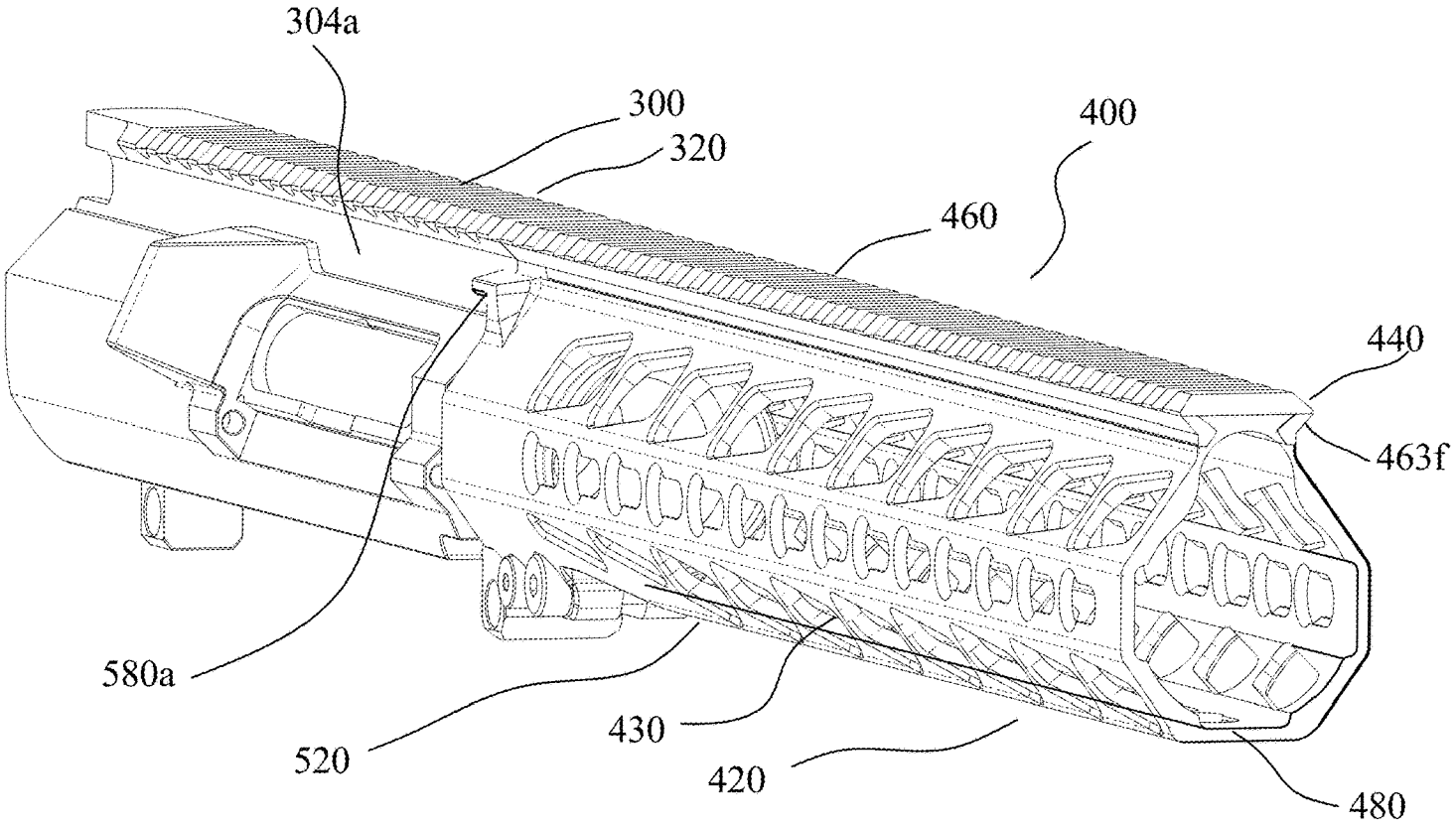
FIG. 11 is a perspective view of a hand guard attached to an upper receiver according to the present invention.
Figure 11A:
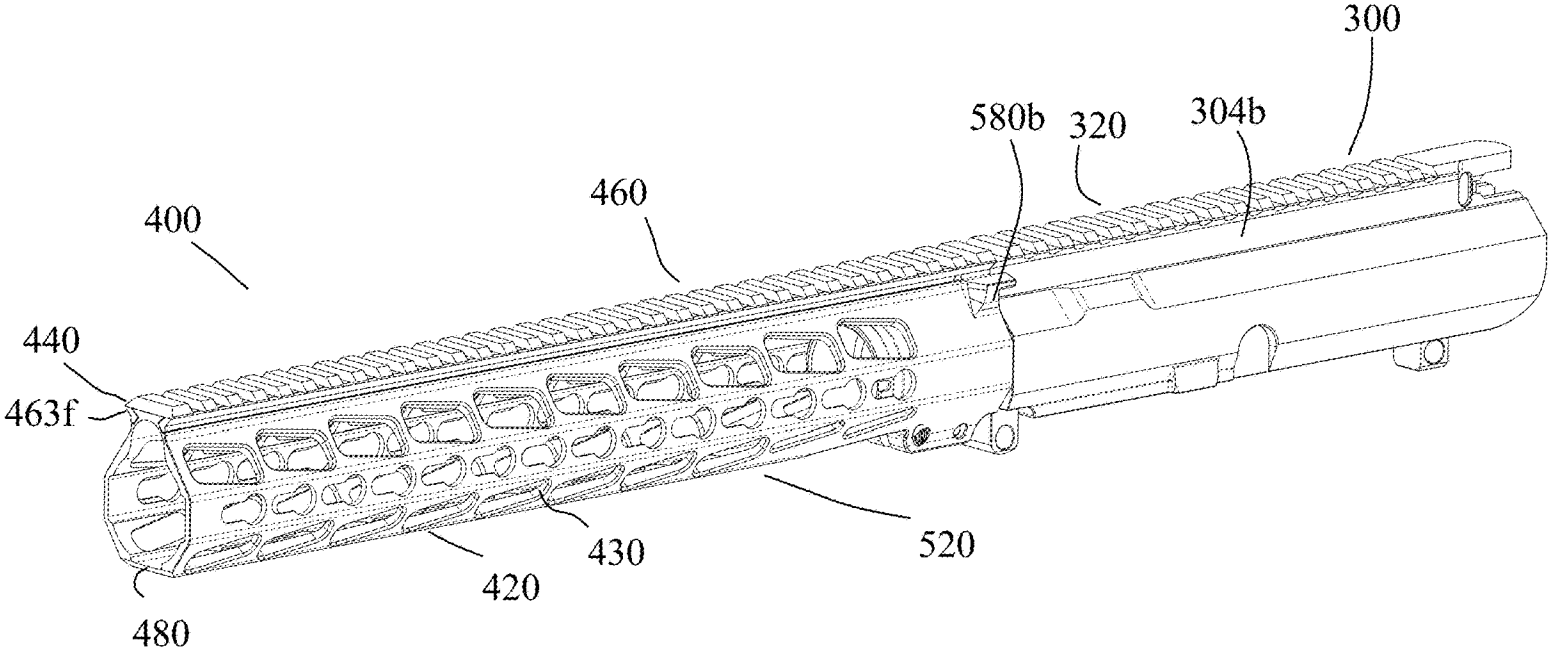
FIG. 11A is an opposite perspective view of the hand guard attached to an upper receiver of FIG. 11.
Figure 12A:
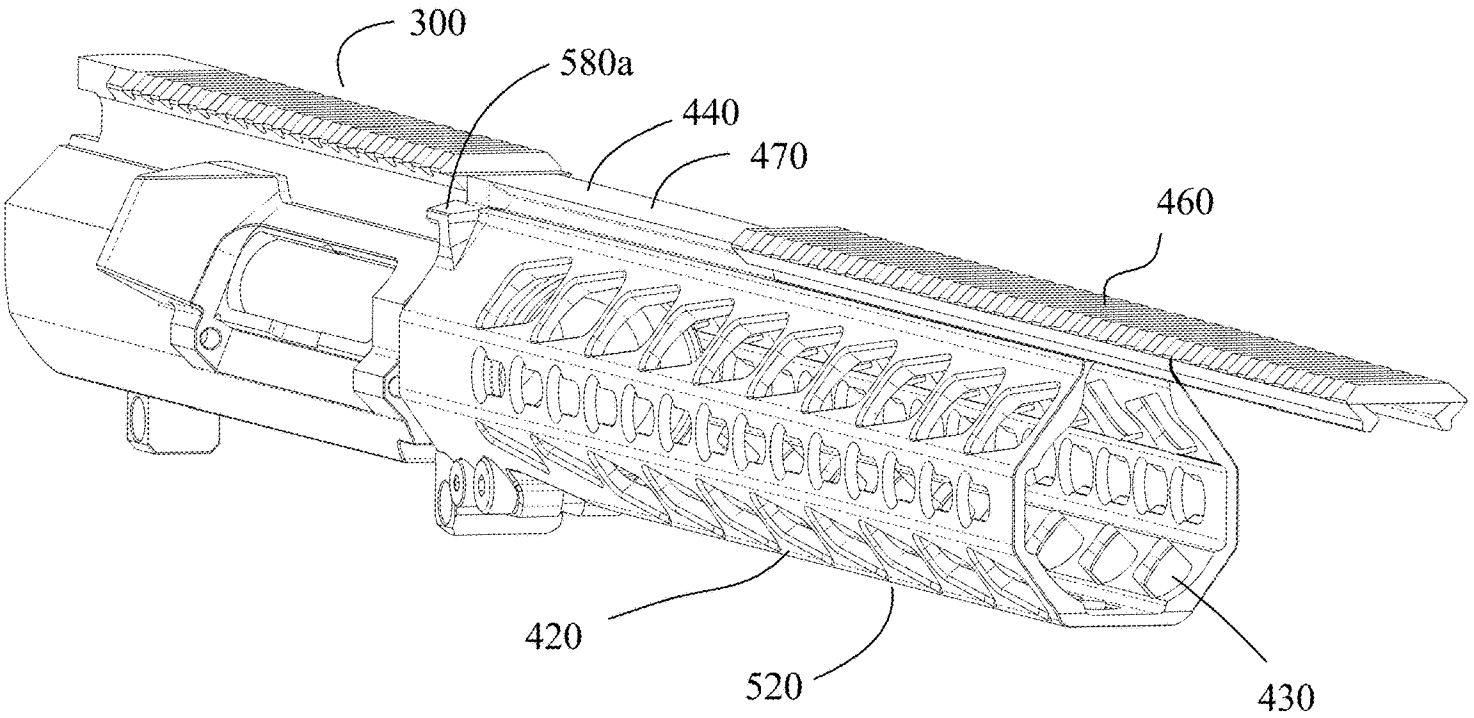
FIG. 12A is a perspective view of a hand guard with a removable Picatinny rail.
Figure 12B:
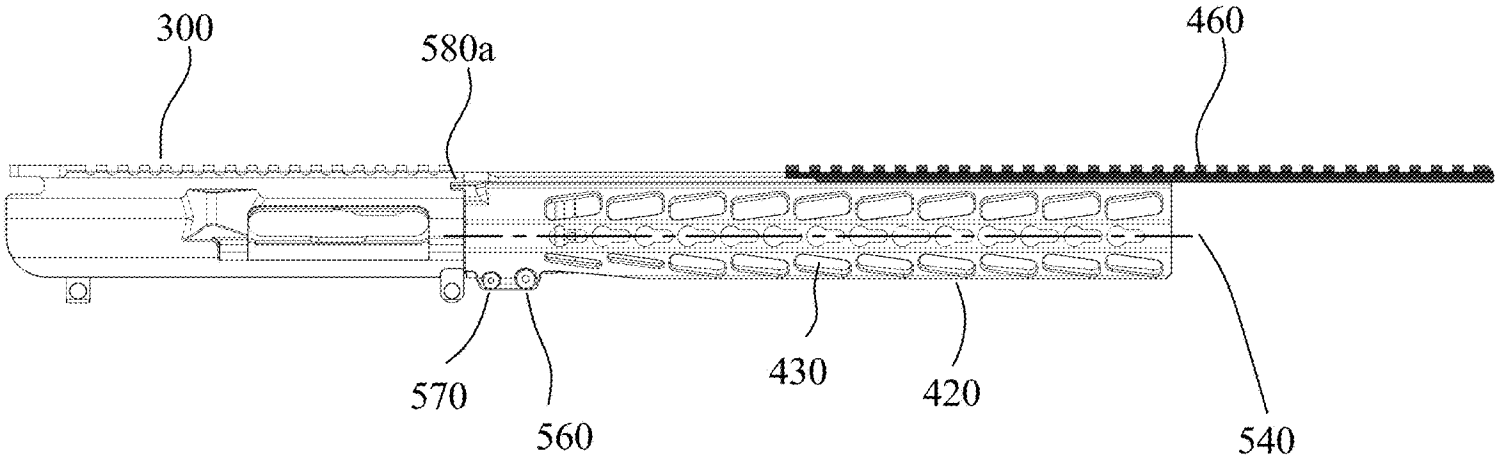
FIG. 12B is a left side view of an upper receiver and hand guard according to the present invention.
Figure 13A:
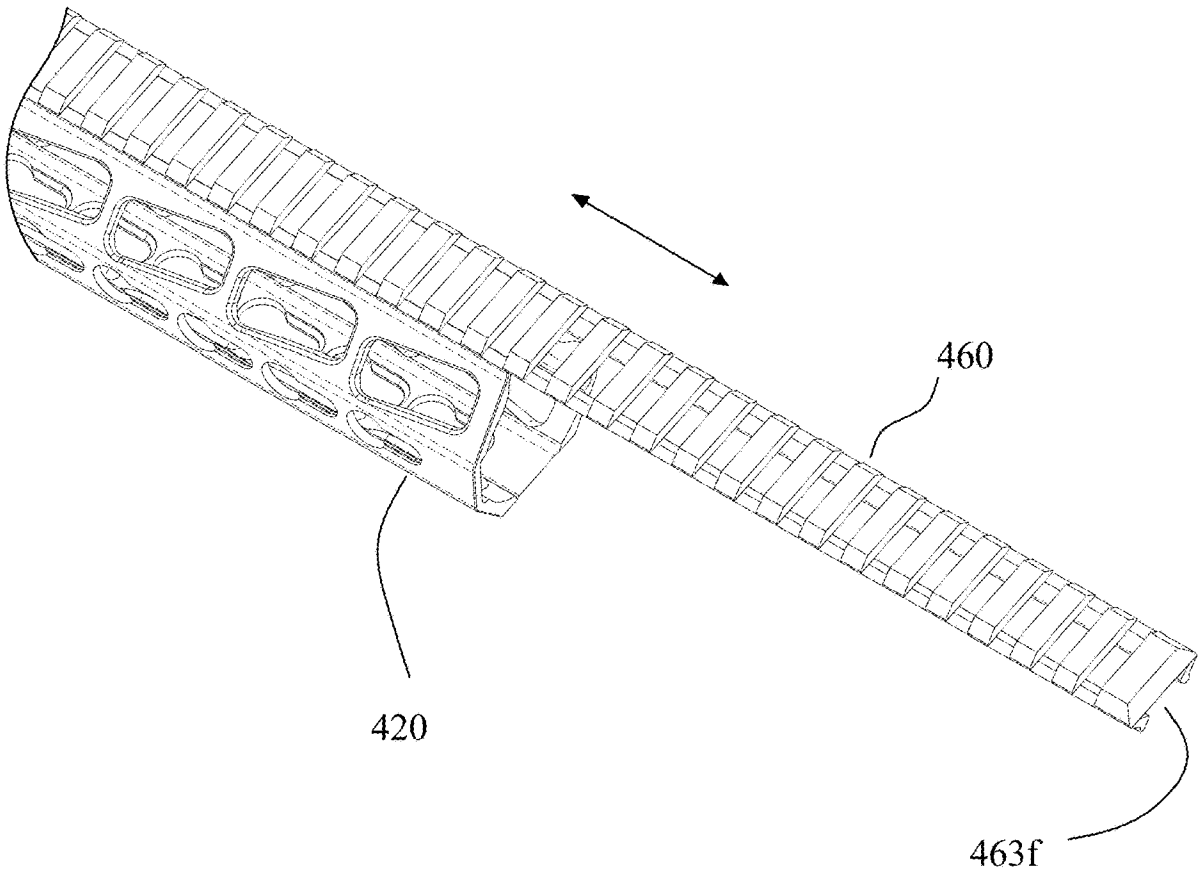
FIG. 13A shows a perspective partial view of a hand guard according to the present invention.
Figure 13B:
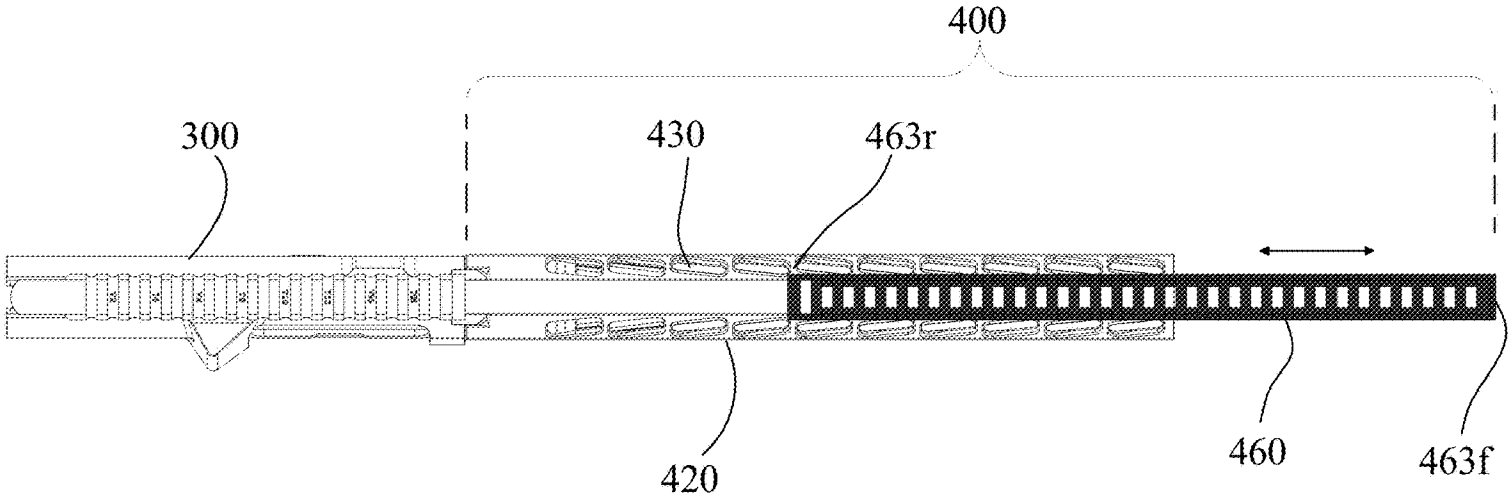
FIG. 13B shows a top view of a hand guard and upper receiver according to the present invention.

In a first embodiment the invention is a hand guard 100 alone or in combination with an upper receiver 300 and more particularly an upper receiver 300 having a Picatinny rail 320 atop thereof (see, for example, FIGS. 1A and 1B). A gun stock 110 is typically attached to one end of the upper receiver 300. The upper receiver is typically located between a rifle barrel 360 and the gun stock 110.

With reference to FIGS. 1A through 9, the hand guard 100 according to the first embodiment comprises a generally hollow single piece cylindrical body 120, a barrel clamp 260, and first 280*a* and second 280*b* tabs. The barrel clamp 260 can be either affixed to the cylindrical boy 120 or form an integral part thereof. The cylindrical body 120 can be manufactured, for example, by aluminum extrusion or aluminum alloy extrusion. The hand guard 100 is preferably made of aluminum or aluminum alloy due to the combination of lightness and excellent heat conductivity properties. However, the hand guard can be made of other metals such as, but not limited to, steel or copper.

In more detail, the cylindrical body 120 has left 125 and right 127 sides, front 180 and rear 200 opposite open ends, a bottom side 220 extending between the front 180 and rear 200 opposite ends, and a longitudinal axis 240. The cylindrical body 120 is populated with vent holes 130. The cylindrical body 120 has a top surface 140 that extends between the front 180 and rear 200 opposite ends. A longitudinal Picatinny rail 160 extends at least part way along the top surface 140 between the front 180 and rear 200 opposite ends of cylindrical body 120. The rail 160 has front 163*f* and rear 163*r* opposite ends. The rail 160 preferably extends immediately from the rear end 200 of cylindrical body 120. More specifically, the rear 163*r* end of rail 160 is adjacent to the rear end 200 of cylindrical body 120 (see, for example, FIG. 1A).

The barrel clamp 260 is positioned at the rear end 180. The barrel clamp 260 extends across the bottom side 220 of the cylindrical body 120 of hand guard 100. The barrel clamp 260 can, for example, be perpendicular to the longitudinal axis 240. A bolt 270 is used to secure the barrel clamp 260 thereby securing the cylindrical body 120, and hence the hand guard 100, around a barrel nut 315 of the upper receiver 300.

Still referring to FIGS. 1A through 9, the rear end 200 includes first 280*a* and second 280*b* tabs which extend from the top surface 140. The first and second tabs 280*a* and 280*b* are respectively on the left 125 and right 127 sides of the cylindrical guard (see, for example, FIG. 6). Specifically, the tabs 280*a* and 280*b* are located proximate to and below the Picatinny rail 160. The tabs 280*a* and 280*b* are spaced apart such that upon connecting the rear end 200 of the cylindrical body 120 to a front end 310*f* of the upper receiver 300 the first tab 280*a* is positioned on a left side 340*a* of the upper receiver 300 and below the Picatinny rail 320 of the upper receiver 300, and the second tab 280*b* is positioned on a right side 340*b* of the upper receiver 300 and below the Picatinny rail 320. The Picatinny rail 320 has front 325*f* and rear 325*r* opposite ends. The terms "left side" and "right side" are as seen looking from the front end 180 of the hand guard 100.

Figure 21:
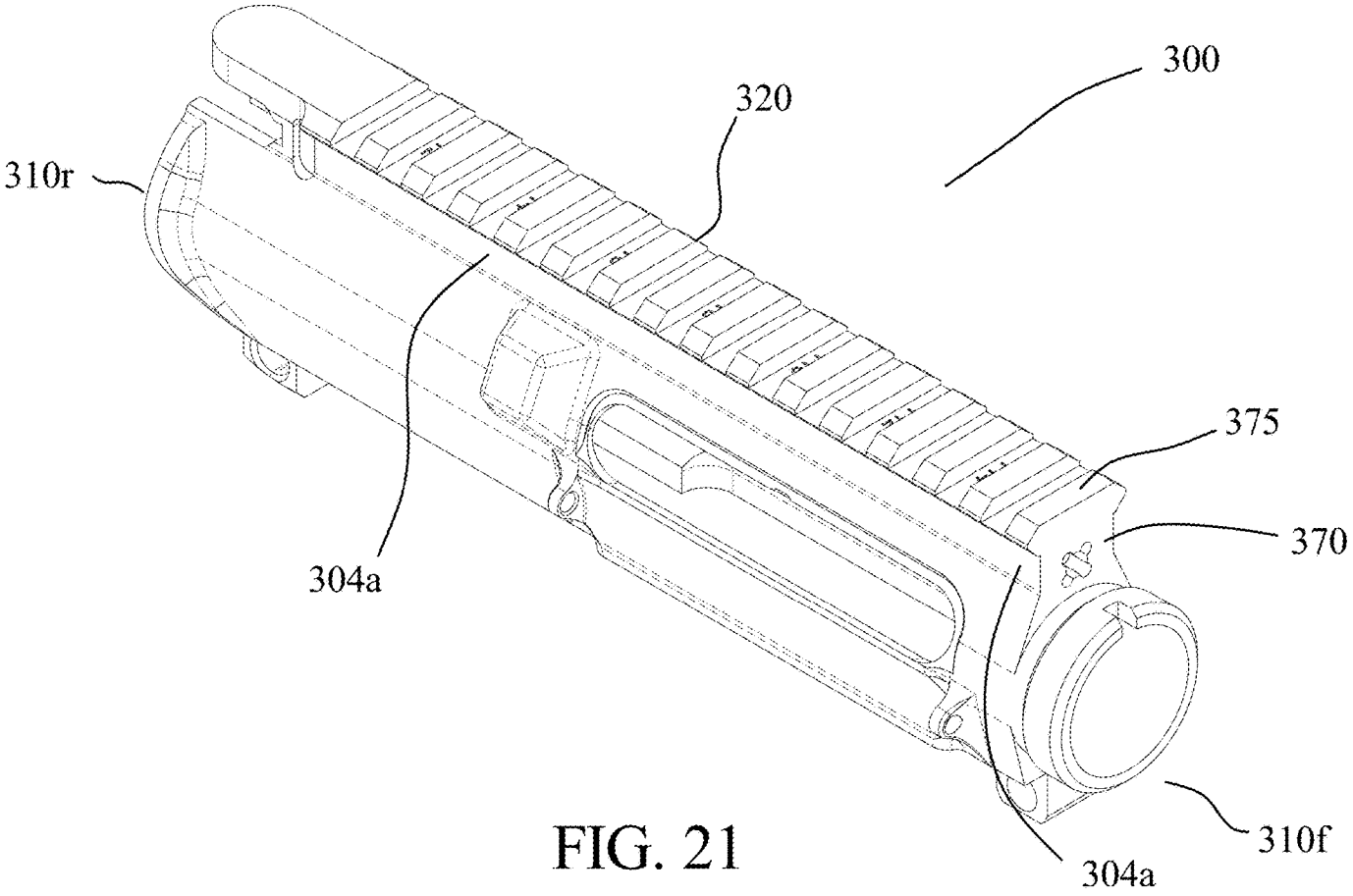
FIGS. 21 and 22 show perspective views of an upper receiver according to the present invention.
Figure 22:
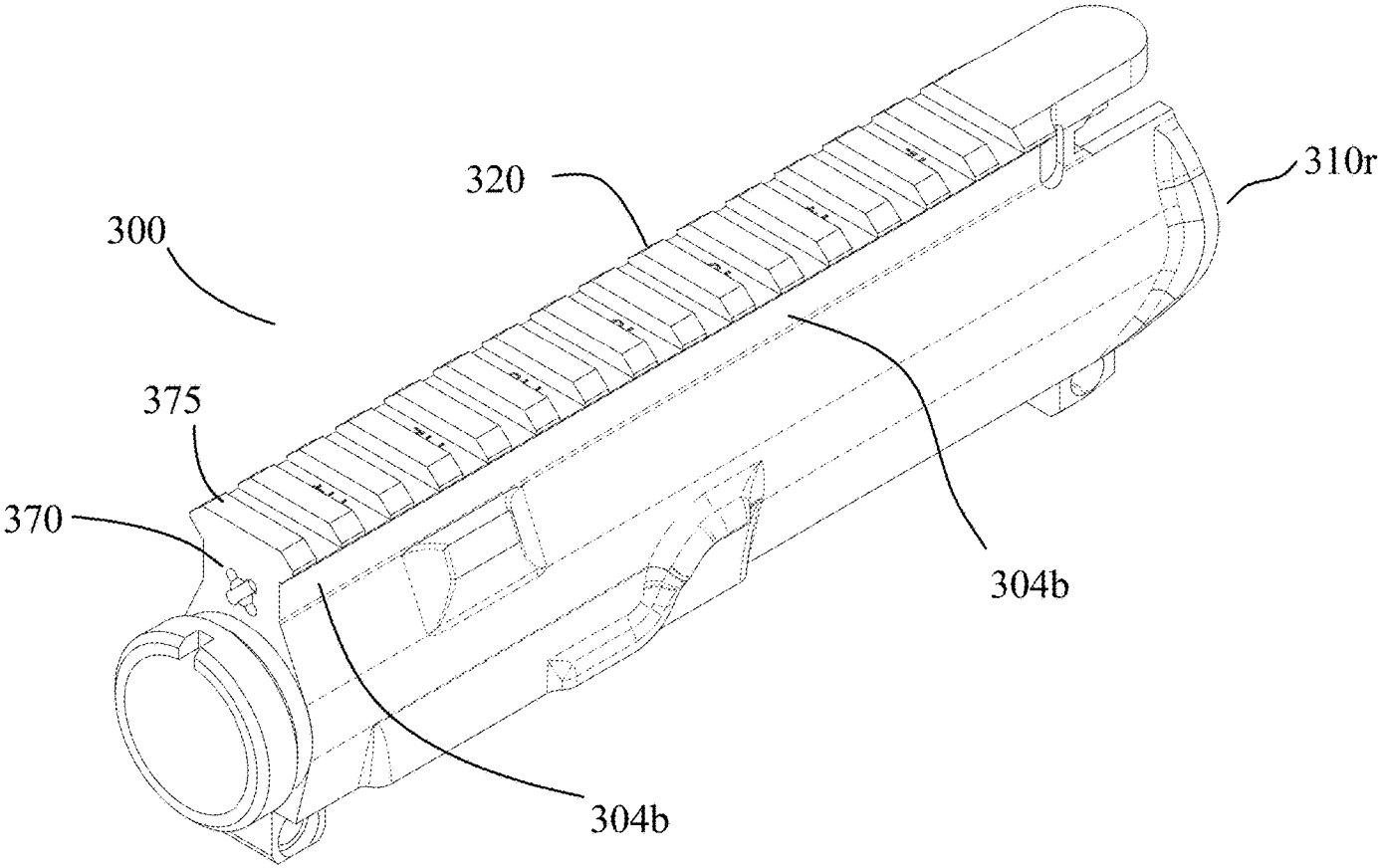

More specifically, the upper receiver 300 has a top surface 302 and a Picatinny rail 320 atop thereof. The upper receiver 300 defines opposite facing first 304*a* and second 304*b* external elongated recesses below the Picatinny rail 320 of the upper receiver 300 (see, for example, FIGS. 21 and 22). The first and second tabs 280*a* and 280*b* respectively fit inside first and second external elongated recesses 304*a* and 304*b*, respectively. The first 304*a* and second 304*b* external elongated recesses extend at least part way between the front 310*f* and rear 310*r* opposite ends of the upper receiver 300 as shown, for example, in FIGS. 21 and 22.

The attachment between the rear end 163*r* of rail 160 and front end 325*f* of Picatinny rail 320 provides a continuous rail for attaching accessories such as, but not limited to, gun sights. The term "continuous" is intended to mean that at the point of contact between rails 160 and 320 the resulting combination rail 365 is continuous such that accessories are attachable at the point of contact between a hand guard rail 160 and the upper receiver Picatinny rail 320. That is, the combination rail 365 is made up of rails 160 and 320.

In more detail, the upper receiver 300 of the invention includes a front face 370 located at the front end 310*f* of the upper receiver 300. The rail Picatinny 320 has a last rail 375 located at front end 325*f* of Picatinny rail 320. The last rail 375 is aligned with the front face 370 (see, for example, FIGS. 21 and 22). Having a last rail 375 aligned to the front face 370 ensures that the combination rail 365 is continuous such that accessories are attachable to the continuous rail 365 at the point of contact between the hand guard rail 160 and the upper receiver Picatinny rail 320.

In a second embodiment the invention is a hand guard 400 alone or in combination with an upper receiver 300 (see FIGS. 10 through 16B). The hand guard 400 comprises a generally hollow cylindrical body 420 having a rail securing top surface 440; a Picatinny top rail 460 securable to the rail securing top surface 440. The rail 460 has front 463*f* and rear 463*r* opposite ends. The top rail 460 is in slidable engagement with the rail securing top surface 440 such that the top rail 460 is removable from the top surface 440. Specifically, a user can hand slide the top rail 460 from the rail securing top surface 440 (see, for example, FIGS. 12A and 13A). The generally cylindrical body 420 is populated with vent holes 430. The cylindrical body 420 can, for example, be manufactured by aluminum extrusion or aluminum alloy extrusion.

The attachment between the front end 325*f* of Picatinny rail 320 and rear end 463*r* of rail 460 provides a continuous rail for attaching accessories such as, but not limited to, gun sights. The term "continuous" is intended to mean that at the point of contact between rails 320 and 460 the resulting combination rail 665 is continuous such that accessories are attachable to the continuous rail proximate to the point of contact and at the point of contact between the hand guard rail 460 and the upper receiver Picatinny rail 320. That is, the combination rail 665 is made up of rails 460 and 320.

Figure 14A:
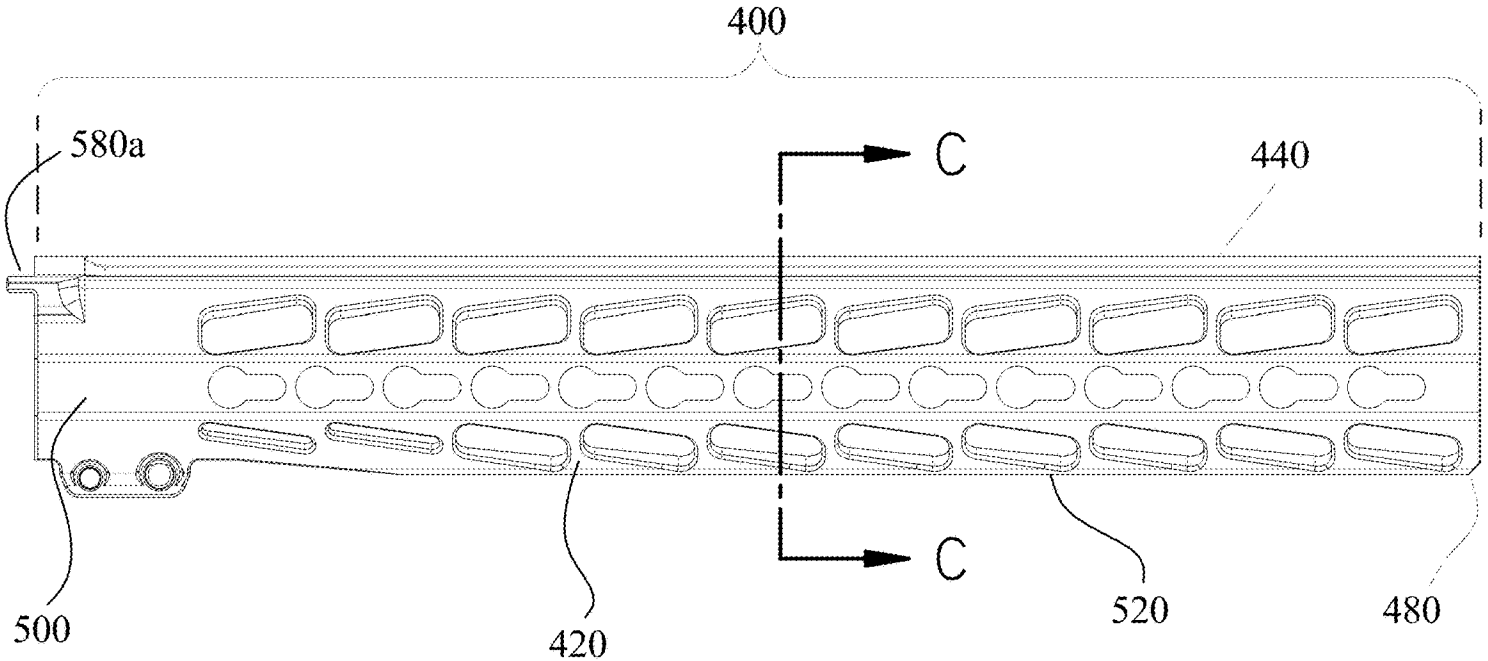
FIG. 14A shows a left side view of a hand guard according to the present invention.
Figure 14B:
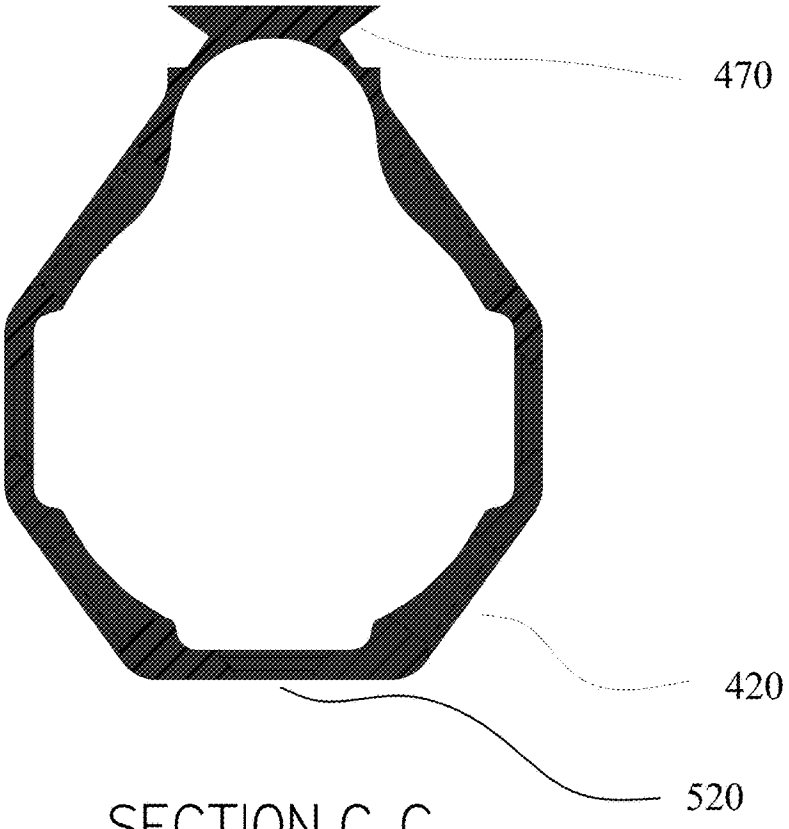
FIG. 14B shows a section view along line C-C shown in FIG. 14A.
Figure 15:
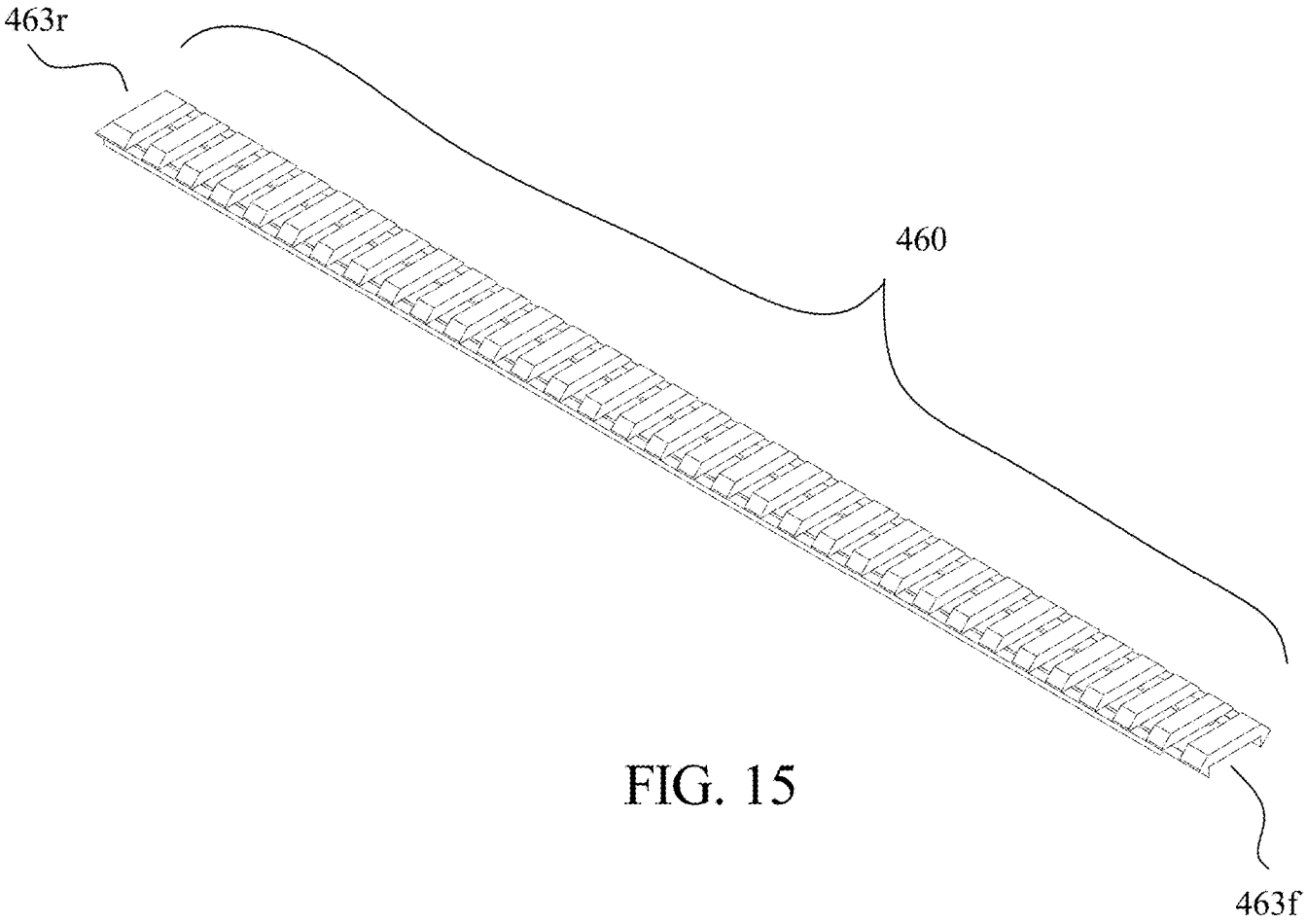
FIG. 15 shows a perspective view of a removable Picatinny rail according to the present invention.
Figure 16A:
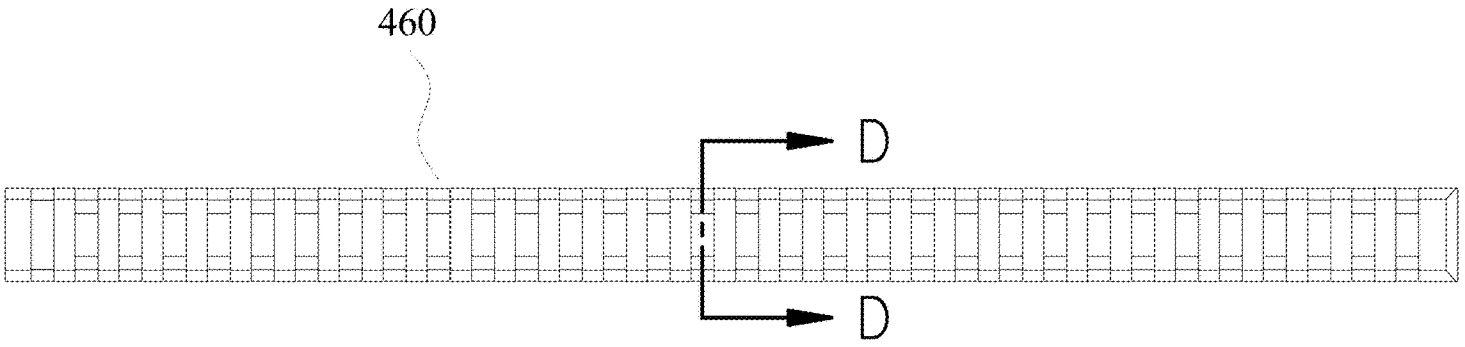
FIG. 16A shows a top view of the removable Picatinny rail shown in FIG. 15.
Figure 16B:
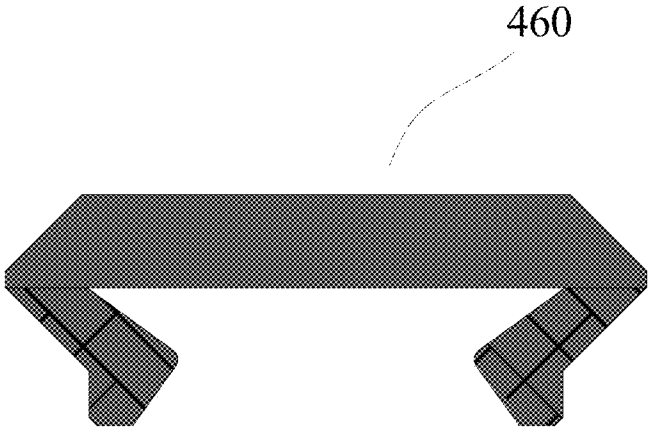
FIG. 16B is a section view along line D-D shown in FIG. 16.

The rail securing top surface 440 can take any suitable form such as a longitudinal protrusion 470 having a dovetail cross-section as shown, for example, in FIG. 14B. The top rail 460 has a cross-section shape for slidable engagement with the rail securing top surface. For example, in FIG.

16B the rail 460 has a cross-section shaped to slidably accommodate the dove-tail cross-section shape of the longitudinal protrusion 470.

In more detail, the cylindrical body 420 has front 480 and rear 500 opposite open ends, a bottom side 520 extending between the front 480 and rear 500 opposite ends, and a longitudinal axis 540. The cylindrical body 420 is populated with vent holes 430. The cylindrical body 420 has a rail securing top surface 440 that extends at least partly between the front 480 and rear 500 opposite ends. A top rail 460 is in slidable engagement with the rail securing top surface 440 such that the top rail 460 is removable from the top surface 440. Specifically, a user (not shown) can pull the top rail 460 thereby sliding the top rail off the rail securing top surface 440.

A barrel clamp 560 is positioned at the rear end 480. The barrel clamp 560 extends across the bottom side 520 of the cylindrical body 420 of hand guard 400. The barrel clamp 560 can, for example, be perpendicular to the longitudinal axis 540. A bolt 570 is used to secure the barrel clamp 560 thereby securing the cylindrical body 420, and hence the hand guard 400, around a barrel nut 315 of the upper receiver 300.

With reference to FIGS. 10 through 16B and FIGS. 21 and 22, the rear end 500 includes first 580*a* and second 580*b* tabs located below the Picatinny rail 460 and extending from the top surface 440. Specifically, the tabs 580*a* and 580*b* are located proximate to and below the Picatinny rail 460. The tabs 580*a* and 580*b* are spaced apart such that upon connecting the rear end 500 of the cylindrical body 420 to a front end 310*f* of the upper receiver 300 the first tab 580*a* is positioned on a left side 340*a* of the upper receiver 300 and below the Picatinny rail 320 of the upper receiver 300, and the second tab 580*b* is positioned on a right side 340*b* of the upper receiver 300 and below the Picatinny rail 320. The terms "left side" and "right side" are as seen looking from the front end 480 of the cylindrical body 420.

As noted above, the upper receiver 300 has a top surface 302 and a Picatinny rail 320 atop thereof. The upper receiver 300 defines opposite facing first 304*a* and second 304*b* external elongated recesses located below the Picatinny rail 320. The first and second external elongated recesses 304*a* and 304*b* extend at least part way between front 180 and rear 200 opposite open ends of cylindrical body 120. The first and second tabs 580*a* and 580*b* respectively fit inside first and second external elongated recesses 304*a* and 304*b*, respectively.

In a third embodiment the invention at least one optional plug 700 is provided alone or in combination with an upper receiver such as but not limited to upper receiver 300 or a hand guard 100 (see, for example, FIGS. 1A through 9B) or 400 (see, for example, FIGS. 10 through 16B). The at least one plug 700 can be supplied separately for later insertion into vent holes of upper receivers or hand guards including vent holes in prior art hand guards and prior art upper receivers.

Figure 17:
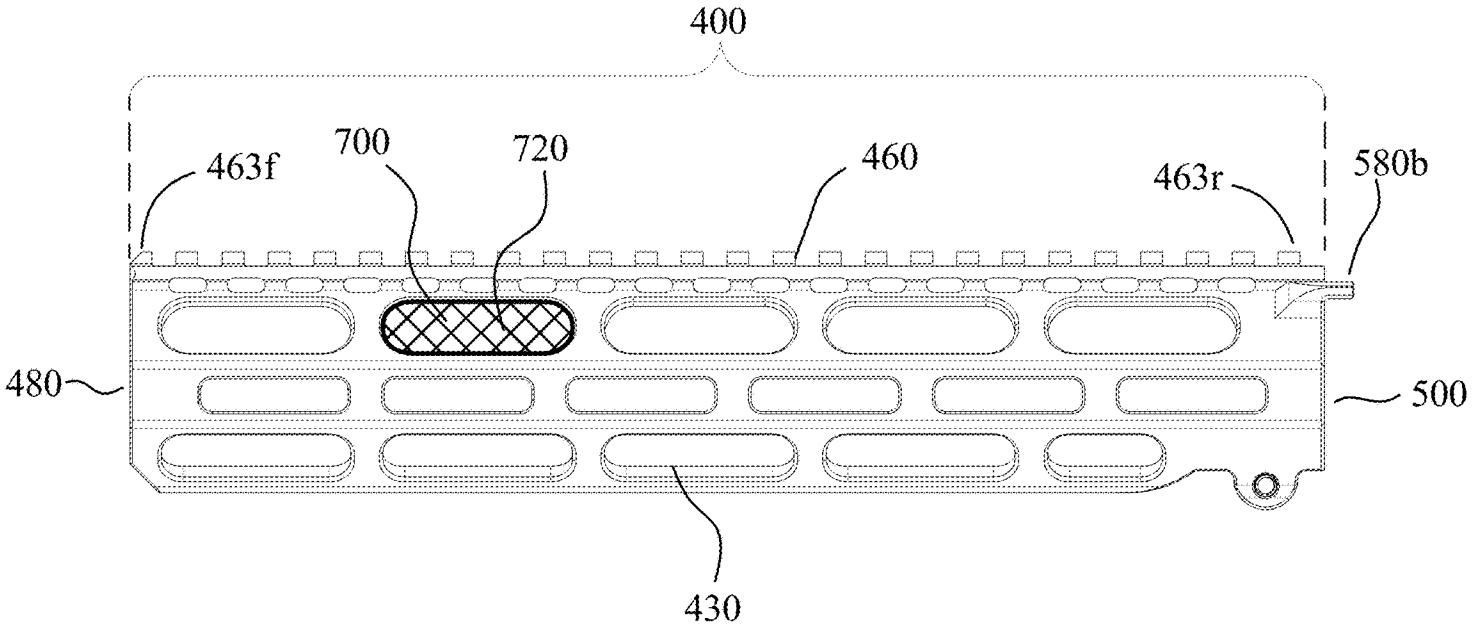
FIG. 17 shows at least one plug fitted in a vent hole according to the present invention.
Figure 18:
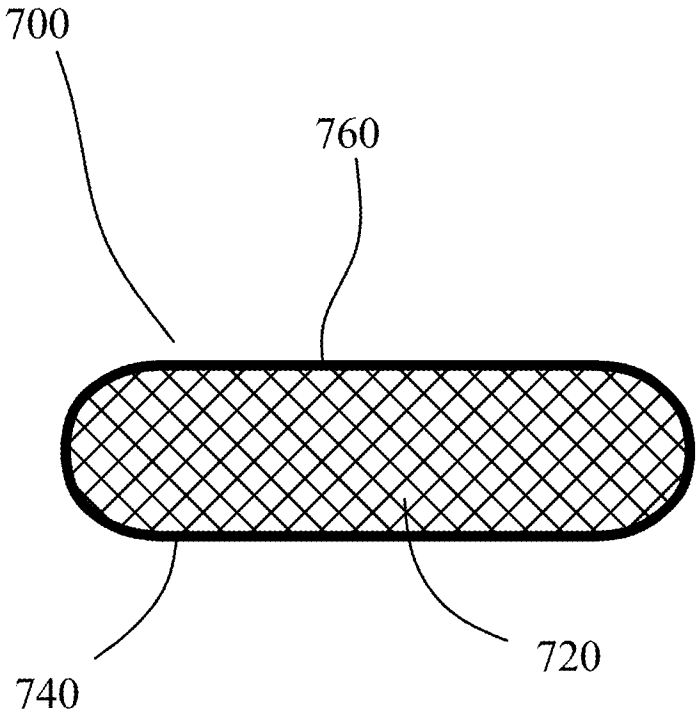
FIG. 18 shows a top view of a plug according to the present invention.

For example, a hand guard 100 (or 400) is optionally populated with ventilation holes 130 with at least one ventilation hole having a plug inserted therein (see, for example, FIG. 17). The at least one plug 700 comprising a wire mesh 720 extending across the plug 700 (see, for example, FIG. 18). The plug includes a perimeter 740 in the form of a rim 760 which defines the edge of the wire mesh 720. The rim 760 and wire mesh can be made of any suitable material such as aluminum or aluminum alloy.

Once the plug 700 is inserted into a vent hole 130 (or 430) the plug 700 serves to improve heat loss to the surrounding air and environment. The wire in the wire mesh 720 can be made of any suitable heat conductive material such as aluminum or alloy comprising of aluminum. The wire mesh 720 can take the form of a single layer of wire or made up of multiple layers of wire to take on a definite three-dimensional appearance. Alternatively, the wire mesh can be made up of an interwoven wire or a plurality of interwoven wires.

It should be understood that the term "plug" and conversely "pop-out" as used hereinafter refers to insertable and extractable ventilation hole plugs that fit inside and are removable from at least one ventilation hole in either an upper receiver or hand guard according to the present invention or a prior art hand guard. The feature of being an insertable and removable plug enables a rifle owner to insert plugs to improve heat exchange. By being removable a rifle owner can remove plugs from ventilation holes of hand guards and/or upper receiver assemblies with ventilation holes to suit a particular mission or gun practice. Specifically, the ventilation holes often have a dual use wherein the ventilation holes facilitate cooling and/or can be used to attach accessories such as, but not limited to, optic accessories.

Figure 19:
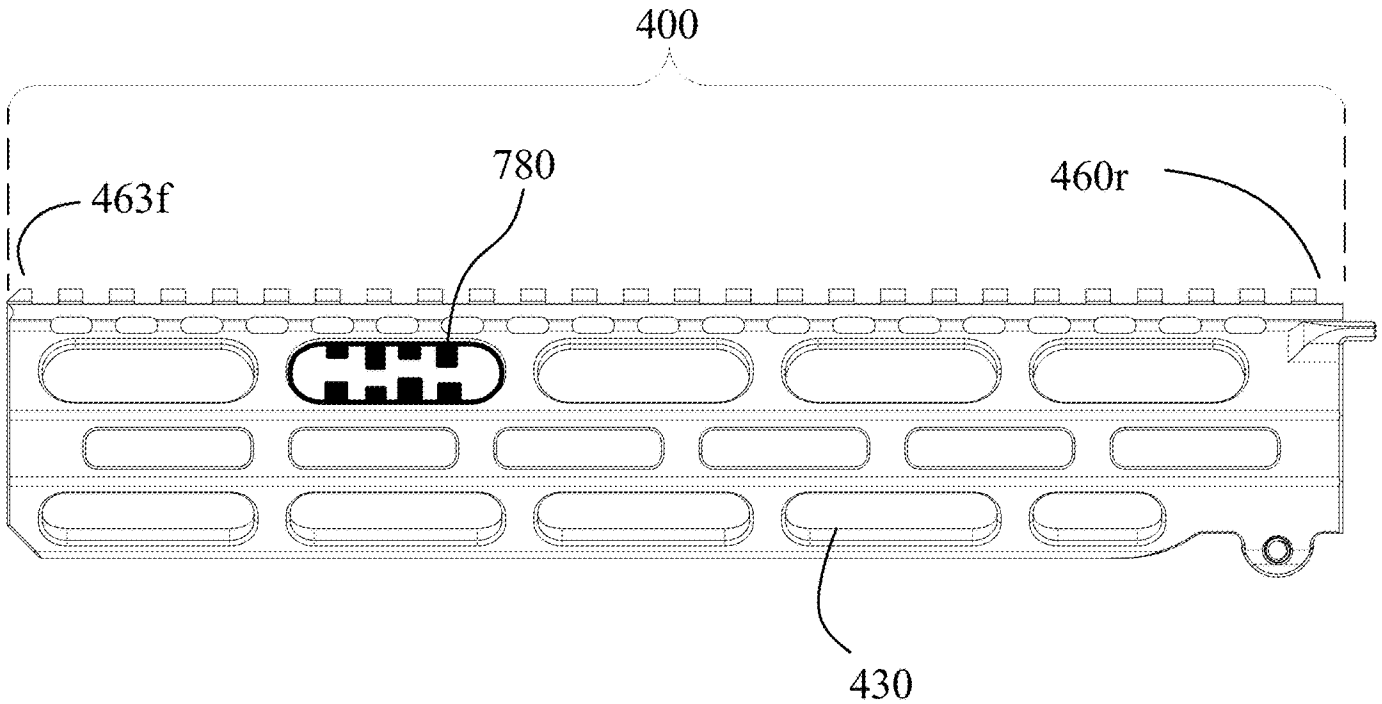
FIG. 19 shows a plug made up of at least one metal strip located in a vent hole according to the present invention.
Figure 20:
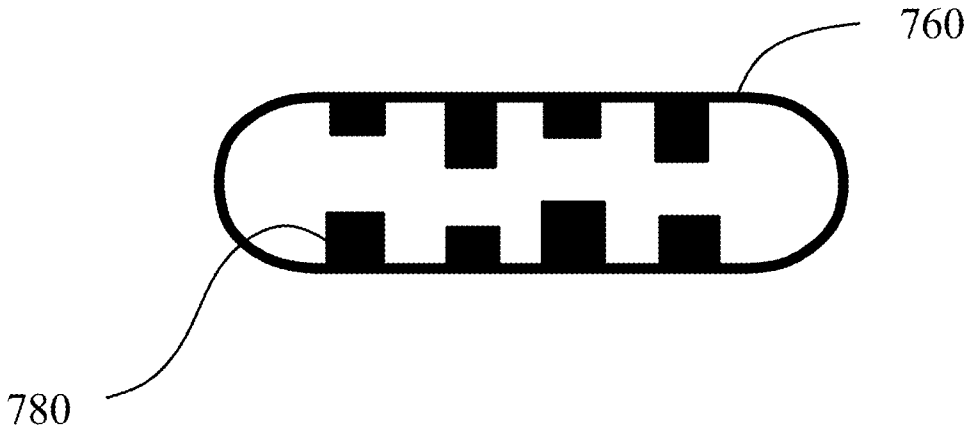
FIG. 20 shows a top view of the plug shown in FIG. 19.

In another embodiment a hand guard according to the present invention is populated with ventilation holes, wherein at least one ventilation hole comprises at least one metal strip 780 extending across the at least one ventilation hole (see FIGS. 19 and 20). The at least one metal strip 780 provides a favorable area: volume ratio for heat loss to the surrounding air and environment.

The at least one metal strip can be made of any suitable heat conductive material such as aluminum or alloy comprising of aluminum. The at least one metal strip can take the form of metal tubes that extend cross the plug. A plug can comprise of at least one metal strip 780 and a rim 760 as shown in FIG. 20. The rim 760 and at least one metal strip can both be made of aluminum or aluminum alloy.

It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed:

1. An upper receiver and hand guard combination, consisting of:

a hand guard comprising a generally hollow single piece cylindrical body having a top surface, wherein a first Picatinny rail extends at least part way along the top surface, the cylindrical body has front and rear opposite open ends, a bottom side extending between the front and rear opposite ends, and a longitudinal axis;

a barrel clamp positioned at the opposite rear end of the cylindrical body, wherein the barrel clamp extends across the bottom side of the hand guard; and an upper receiver, wherein the upper receiver includes a front face located at a front end of the upper receiver, the upper receiver having a second Picatinny rail, wherein the first and second Picatinny rails each being made up of individual rails, the individual rails of the first and second Picatinny rails have the same dimensions, wherein the second Picatinny rail having a last individual rail located at a front end of the second Picatinny rail, wherein the last individual rail of the second Picatinny rail is aligned with the front face, and a barrel nut connected to the front end of the upper receiver, wherein the first Picatinny rail extends immediately from the opposite rear end of the cylindrical body, wherein the opposite rear end of the cylindrical body includes first and second tabs located below the first Picatinny rail and extending from the opposite rear end of the cylindrical body, and wherein the first and second Picatinny rails form a combination rail, wherein having a last individual rail aligned to the front face of the upper receiver ensures that the combination rail is continuous upon contact of the hand guard to the upper receiver such that accessories are attachable at a point of contact of the first and second Picatinny rails, and wherein the cylindrical body of the hand guard is populated with vent holes.

* * * * *